US010905912B2

(12) United States Patent
Thomas

(10) Patent No.: US 10,905,912 B2
(45) Date of Patent: Feb. 2, 2021

(54) WORKOUT APPARATUS WITH TELESCOPING LEGS

(71) Applicant: Tristan Thomas, St. Louis, MO (US)

(72) Inventor: Tristan Thomas, St. Louis, MO (US)

( * ) Notice: Subject to any disclaimer, the term of this patent is extended or adjusted under 35 U.S.C. 154(b) by 50 days.

(21) Appl. No.: 16/177,713

(22) Filed: Nov. 1, 2018

(65) Prior Publication Data

US 2020/0139181 A1 May 7, 2020

(51) Int. Cl.

*A63B 1/00* (2006.01)
*A63B 21/078* (2006.01)
*A63B 23/12* (2006.01)

(52) U.S. Cl.

CPC ..... *A63B 1/00* (2013.01); *A63B 21/078* (2013.01); *A63B 23/1227* (2013.01); *A63B 2210/50* (2013.01); *A63B 2225/093* (2013.01)

(58) Field of Classification Search

CPC ..... Y10T 403/32483; Y10T 403/32475; Y10T 403/32467; F16B 7/105; A63B 23/1227; A63B 21/078; A63B 2225/093

See application file for complete search history.

(56) References Cited

U.S. PATENT DOCUMENTS 1,410,149 A 3/1922 Williams et al.
2,817,522 A * 12/1957 Margulies ..... A63B 17/00 482/145
4,256,300 A 3/1981 Boucher
4,586,399 A * 5/1986 Kassai ..... B62B 7/08 74/551.3
4,863,162 A * 9/1989 Neckamm ..... A63B 21/05 482/128
4,921,245 A 5/1990 Roberts
5,116,297 A 5/1992 Stonecipher
5,290,209 A 3/1994 Wilkinson
5,389,055 A 2/1995 Gangloff
5,662,429 A 9/1997 Battocchio
6,409,412 B1 6/2002 Huang
6,551,226 B1 4/2003 Webber et al.
6,908,249 B2 6/2005 Tomm
7,040,832 B2 5/2006 Hsieh
7,097,380 B2 * 8/2006 Lee ..... F16B 7/105 15/80
7,125,371 B2 10/2006 Henderson
7,293,934 B1 * 11/2007 Huang ..... F16B 7/105 403/109.1

(Continued)

OTHER PUBLICATIONS https://www.pullupmate.com/, at least as early as Nov. 1, 2018.
https://khanhtrinhvn.com/, at least as early as Nov. 1, 2018.

*Primary Examiner* — Daniel J Wiley
(74) *Attorney, Agent, or Firm* — Husch Blackwell LLP

(57) ABSTRACT

A workout apparatus having a crossbar with a first end and a second end, with each end of the crossbar engaging a pivot mount. The workout apparatus having four legs, with each pivot mount further engaging two legs therefore allowing the legs to be selectively rotatable around each of the pivot mounts in both a lateral axis and longitudinal axis of the crossbar. The workout apparatus having a first position where each pair of legs engaging each pivot mount at an angle greater than zero relative to each other and supporting the crossbar. The workout apparatus having a second position where the four legs are adjacent to the crossbar and positioned within the longitudinal plane of the crossbar.

5 Claims, 39 Drawing Sheets

(56) References Cited

U.S. PATENT DOCUMENTS

| | | | | |
|---|---|---|---|---|
| 7,364,530 | B2 | 4/2008 | Lopez | |
| 7,581,288 | B2 * | 9/2009 | Zhang | A47L 9/244 15/414 |
| 7,980,519 | B2 | 7/2011 | Chen | |
| 8,033,960 | B1 | 10/2011 | Dalebout et al. | |
| 8,079,915 | B2 * | 12/2011 | Spencer | A63G 9/00 472/118 |
| 8,376,646 | B2 * | 2/2013 | Melino, Sr. | F16B 7/1454 403/109.3 |
| 8,398,530 | B1 | 3/2013 | Rubens | |
| 8,808,147 | B2 | 8/2014 | Gillespie et al. | |
| 8,961,057 | B2 * | 2/2015 | Schroeder | F16C 11/10 403/102 |
| 9,675,829 | B1 * | 6/2017 | Katz | A63B 1/00 |
| 2009/0206226 | A1 * | 8/2009 | Forrest | A47C 7/002 248/354.6 |
| 2012/0085380 | A1 * | 4/2012 | Buckley | E04H 15/46 135/140 |
| 2012/0107037 | A1 * | 5/2012 | Huang | F16B 7/105 403/109.3 |
| 2013/0217544 | A1 | 8/2013 | Anaya | |

* cited by examiner

WORKOUT APPARATUS WITH TELESCOPING LEGS

FIELD OF INVENTION

The present invention relates to exercise devices, and more particularly to foldable and portable exercise devices.

BACKGROUND

Workout apparatuses used in the home allow for multiple exercises, and can also be easily stowed away when not in use are known in the art. Many workout apparatuses offer multiple exercises on the same equipment. For example, a pullup bar may be configured into a dip apparatus, or into a squat rack for holding a barbell. Additionally, it is known to those skilled in that art that workout apparatuses may be size adjustable to fit a variety of individuals that may use the apparatus. For example, an apparatus including a pullup bar may be adjustable in height to better fit both taller and shorter individuals, such as the Khanh Model KT1. Prior art apparatuses which are height adjustable traditionally use telescoping legs with internal spring pin locks, such as in U.S. Pat. No. 5,290,209. In order to adjust the height of these apparatuses, the user depresses the pin and manually slides the pin past each aperture until the telescoping legs are at the desired height. Accordingly, a user cannot simply depress the pin for an extended period of time until the desired height is reached, but must instead repeatedly depress the pin and slide it past each aperture. Other known exercise devices have external locking mechanisms, such as in U.S. Pat. No. 6,551,226, used for varying the height of the device. However, external locking mechanisms known in the art only restrict movement in a single direction. It is therefore desirable to provide a more efficient locking mechanism capable of restricting movement in multiple directions that may be used with height adjustable apparatuses.

It is also desirable to provide an easily collapsible and stowable apparatus that still allows individuals to perform a variety of workouts, and is sturdy enough to provide a safe exercise apparatus when assembled. Workout apparatuses must be capable of supporting heavy weights and forces from barbells, weights, and the user's own body weight. Accordingly, workout apparatuses are inherently bulky which limits their collapsibility and stowing capabilities. Known devices that are capable of collapsing from an assembled configuration into a stowable configuration typically involve a full or partial disassembly of the device, or only partially folds or collapses into a smaller arrangement. For example, U.S. Pat. No. 7,364,530 discloses a collapsible device where the legs can fold inwardly towards the crossbar, but cannot fold in other directions while being collapsed. Accordingly, these known foldable apparatuses are limited by single axes of rotation. Therefore, it is desirable for a collapsible exercise device that can be rotated about multiple axes, which thereby can be arranged in a more compact and stowable configuration.

Examples of known workout apparatuses are described in the references listed below, which are hereby incorporated by reference. U.S. Pat. Nos. 5,389,055-5,662,429-6,908,249-7,125,371-7,040,832-7,364,530-7,980,519 U.S. Pat. No. 8,033,960-8,398,530-5,290,209-6,551,226-4,921,245-4,256,300-6,409,412 U.S. Pat. No. 5,116,297-1,410,149-8,808,147-US20130217544.

SUMMARY OF INVENTION

A portable exercise device having a crossbar and frame having two pairs of telescoping legs rotatably connected at opposite ends of the crossbar forming a pair of inverted "V" shapes that support the crossbar, barbells, weights and body weight of the user. The telescoping legs having at least two sections, an inner section which slides within an outer section, and is held into place with a locking mechanism at different lengths. Accordingly, the height of the crossbar, and thus entire device, can be altered by varying the heights of the legs. Additionally, the pivot mount connecting the telescoping legs to the crossbar further allows the user to alter the height of the crossbar by adjusting the angle between each leg.

The locking mechanism has a base attached to the outer section of the telescoping leg and a lock leg section attached to the base which engages with the telescoping leg apertures within the inner section of the telescoping leg. The total height of each telescoping leg is thereby varied depending on which telescoping leg aperture is engaged by the lock leg section. The lock leg section is biased towards the inner section of the telescoping leg by a torsional spring and remains within a telescoping leg aperture, locking the telescoping legs at the desired height. In one embodiment, to disengage the lock leg section, the user presses on the proximal end of a lock lever section, attached to and creating a lever with the lock leg section, thereby pivoting the lock leg section out of the telescoping leg aperture. Accordingly, the inner section can then freely slide within the outer section to either extend or shorten the telescoping leg.

In another novel feature of the workout apparatus, the device can be folded into a compact shape, which allows for easy storage and convenience. On opposite ends of the crossbar are two pivot mounts having at least one axis of rotation parallel to the crossbar and another axis of rotation that is perpendicular to the crossbar. A pair of telescoping legs is attached to the crossbar at opposite ends and can move latitudinally in relation to the crossbar, forming various acute angles between the legs, as well as longitudinally relative to the crossbar by way of the pivot mount. When the telescoping legs are locked at an acute angle relative to one another, the workout apparatus can stand on its own. However, the legs can be rotated in relation to the crossbar allowing the user to fold the legs into a plurality of different positions, including a folded arrangement where the telescoping legs and crossbar are within a single plane. For instance, the legs can be locked both perpendicularly to the main crossbar in on arrangement and parallel to the main crossbar in another arrangement. Ultimately, the user can rotate each pair of telescoping legs inwardly toward the crossbar until each pair of legs is substantially parallel to the crossbar, allowing for convenient storage with all the telescoping legs and crossbar in a single row.

In another aspect of the invention, the crossbar is locked in place between the telescoping legs and a pair of dip bars is attached to the crossbar and perpendicularly extends away therefrom. When the dip bars are attached and a user applies their body weight to the distal end of the dip bars, a torsional force is applied to the crossbar. Accordingly, the pair of dip bar pins is inserted through an aperture in the crossbar and locked into the pivot mounts proximate to the telescoping legs on each end of the crossbar in order to prevent the crossbar from spinning due to the torsional force placed on the dip bars.

In another aspect of the invention, additional support can be added to the legs and the apparatus by attaching a rigid link between the pair of telescoping legs, thereby creating an "A" shape with the rigid link acting as the cross section of the "A" and locking the legs at various desired acute angles. When a user intends to widen or narrow the angle between the legs, the rigid link is disengaged and readjusted to the preferred angle. To collapse the device all together, the user releases one side of the rigid link or removes the rigid link all together and pulls an adjuster pin to rotate the workout apparatus into the stowed arrangement.

In another aspect of the invention, an adjustable barbell rack may be added to the telescoping legs. The barbell rack is made from two mounts attached opposite from one another at corresponding heights on two of the legs. Protrusions on the mounts are inserted into the apertures within the telescoping legs and locked thereto by a safety pin. The protrusions are spaced on the mount relative to the spacing between the apertures in the telescoping legs and thus the mounts can be positioned at any height on the legs. Additionally, the mounts each have a lip extending perpendicularly from the mount and upwards towards the crossbar to hold a barbell that may be used for exercises including but not limited to squats and bench-presses.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

For a better understanding of the various embodiments of the present invention, reference may be made to the accompanying drawings in which.

Figure 1:
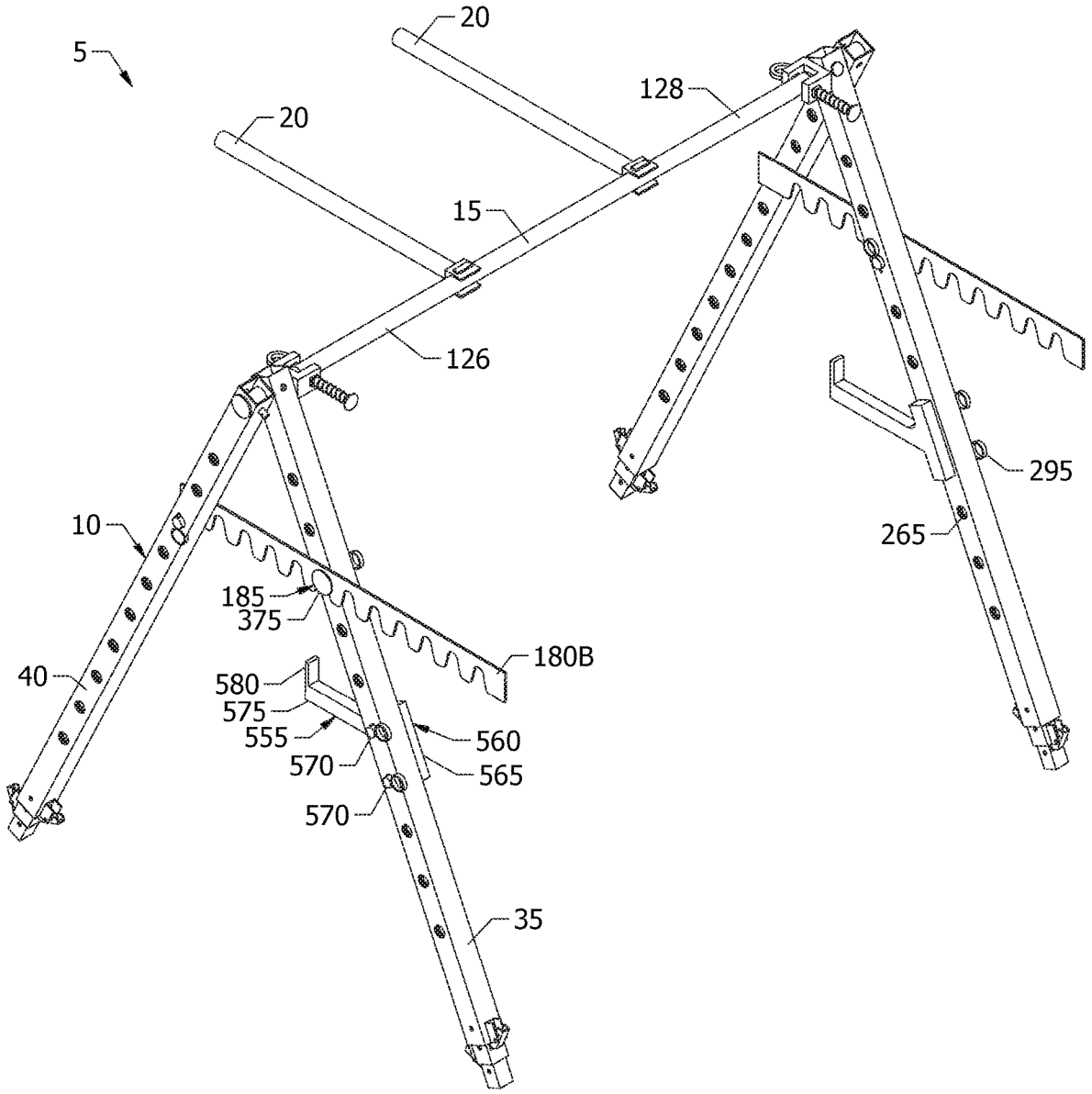
FIG. 1 is a perspective view of a first embodiment of a workout apparatus.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiments disclosed, but on the contrary, the intention is to cover all modifications, equivalents, and alternatives falling within the spirit and scope of the present disclosure.

DETAILED DESCRIPTION OF THE DRAWINGS

The present invention will now be described with reference to the drawing figures, in which like reference numerals refer to like parts throughout. For purposes of clarity in illustrating the characteristics of the present invention, proportional relationships of the elements have not necessarily been maintained in the drawing figures.

Turning to FIG. 1, a portable workout apparatus 5 is provided. The workout apparatus 5 allows a user to perform a variety of exercises at home. The workout apparatus 5 includes two pairs of telescoping legs 10, where each pair of telescoping legs 10 includes an inner telescoping leg 35 and an outer telescoping leg 40. Each telescoping leg 35 and 40 further includes at least two leg sections, described in more detail below. Each pair of telescoping legs 10 creates an inverted "V" shape, allowing the workout apparatus 5 to stably support the weight of the user. Each pair of telescoping legs 10 is attached to a crossbar 15, which will be described in more detail hereinafter. The telescoping legs 10 are height adjustable, therefore allowing the user to modify the height of the crossbar 15 to his personal preference, which will also be described in more detail hereinafter. In one embodiment, the workout apparatus 5 may also have a pair of dip bars 20 attached to the crossbar 15, also described in more detail below.

Figure 2:
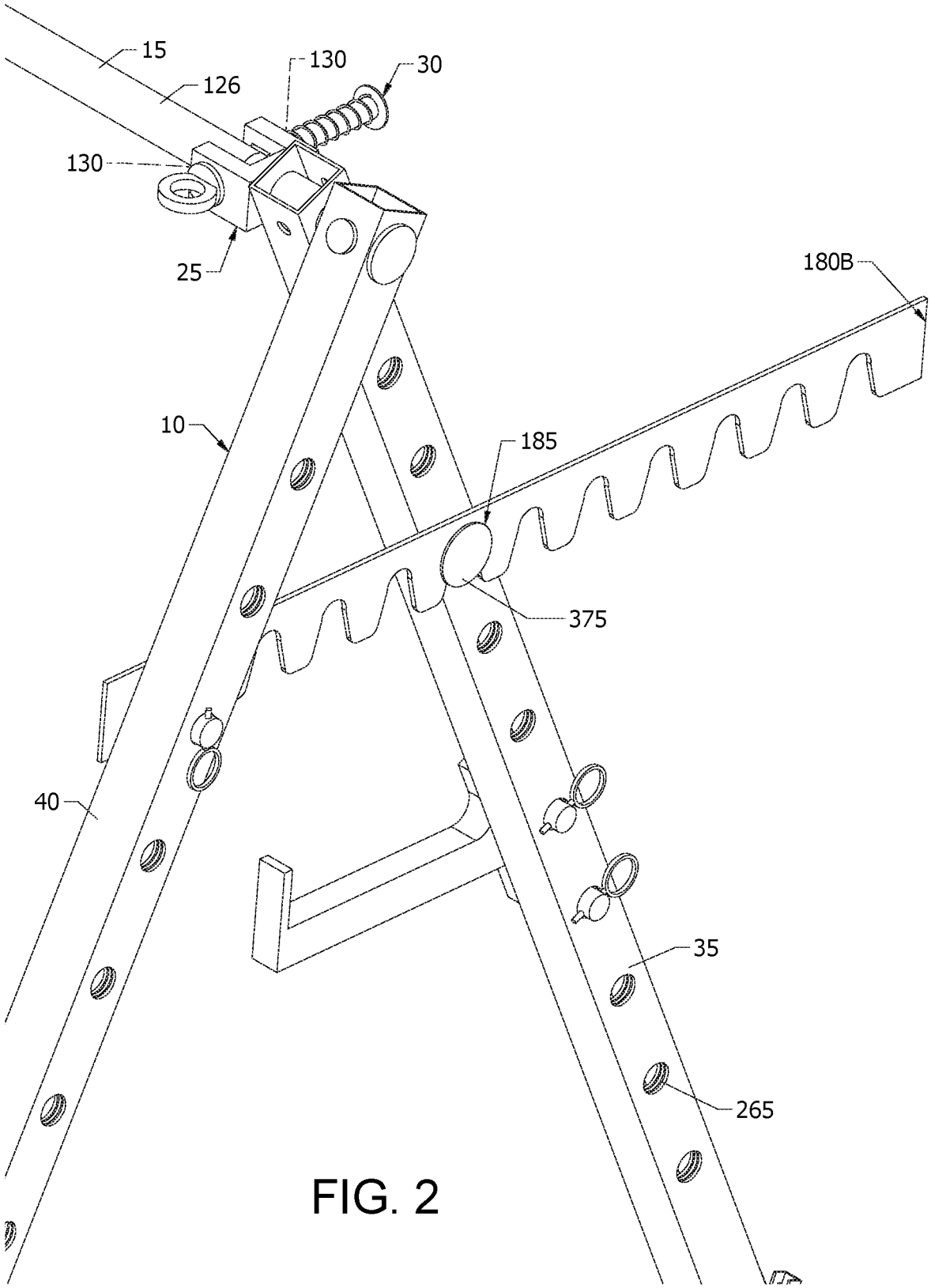
FIG. 2 is an enlarged view of a portion of the first embodiment of the workout apparatus of FIG. 1.

As seen in FIG. 2, each pair of telescoping legs 10 is attached to either a first end 22 or a second end 23 of the crossbar 15. A pivot mount 25 and an adjuster pin 30 may be used to secure the telescoping legs 10 to the crossbar 15. Each pair of telescoping legs 10 includes the inner telescoping leg 35 and the outer telescoping leg 40, which each further includes a pivot mount aperture 45, so that the pivot mount aperture 45 extends through each telescoping leg 35 and 40. Using the pivot mount apertures 45, the pivot mount 25 connects the telescoping legs 35 and 40 to the first end 22 or the second end 23, respectively, of the crossbar 15, which will be explained in more detail below.

Figure 3:
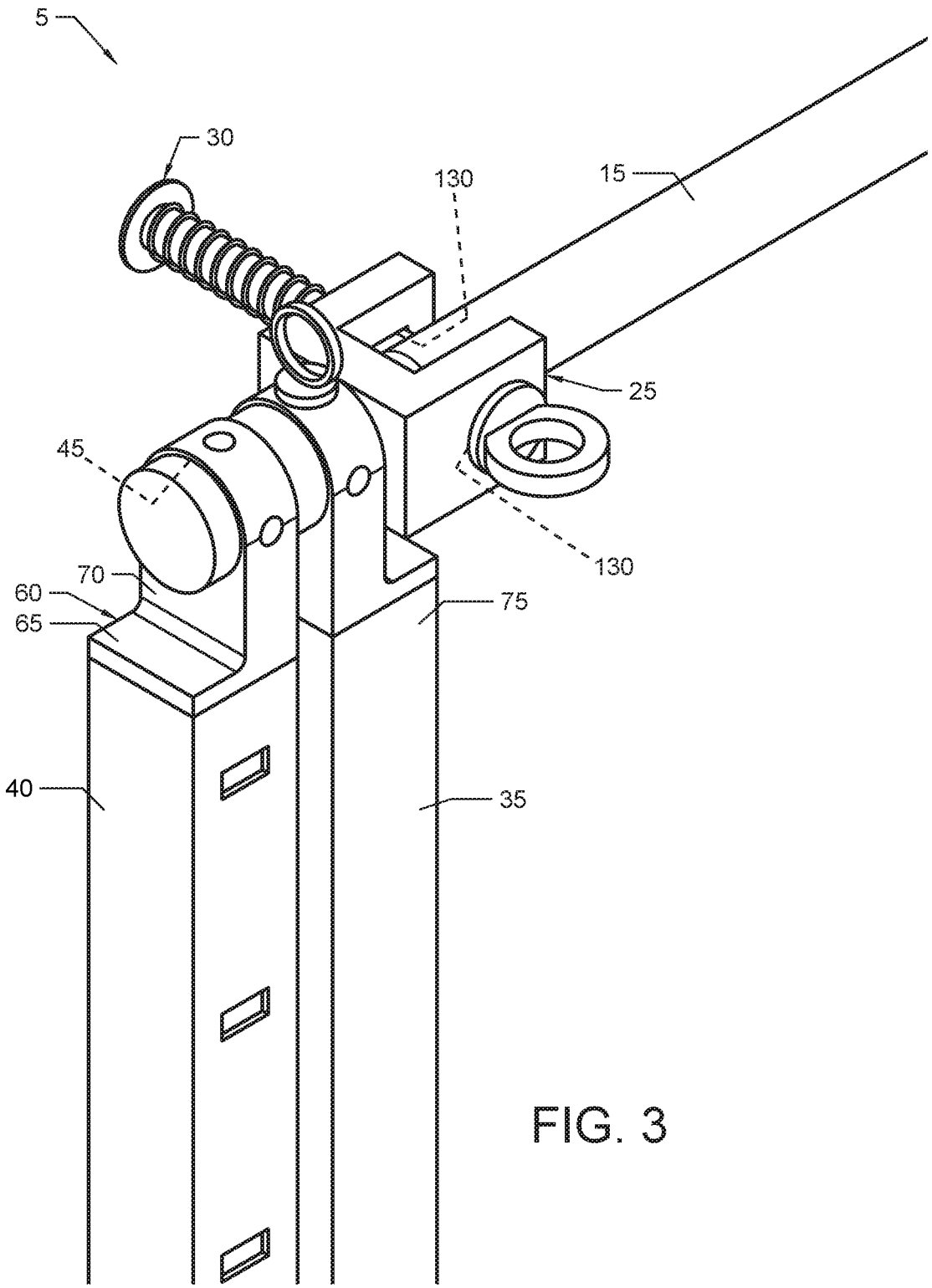
FIG. 3 is an enlarged view of a portion of an alternative embodiment of the workout apparatus of FIG. 1.
Figure 4:
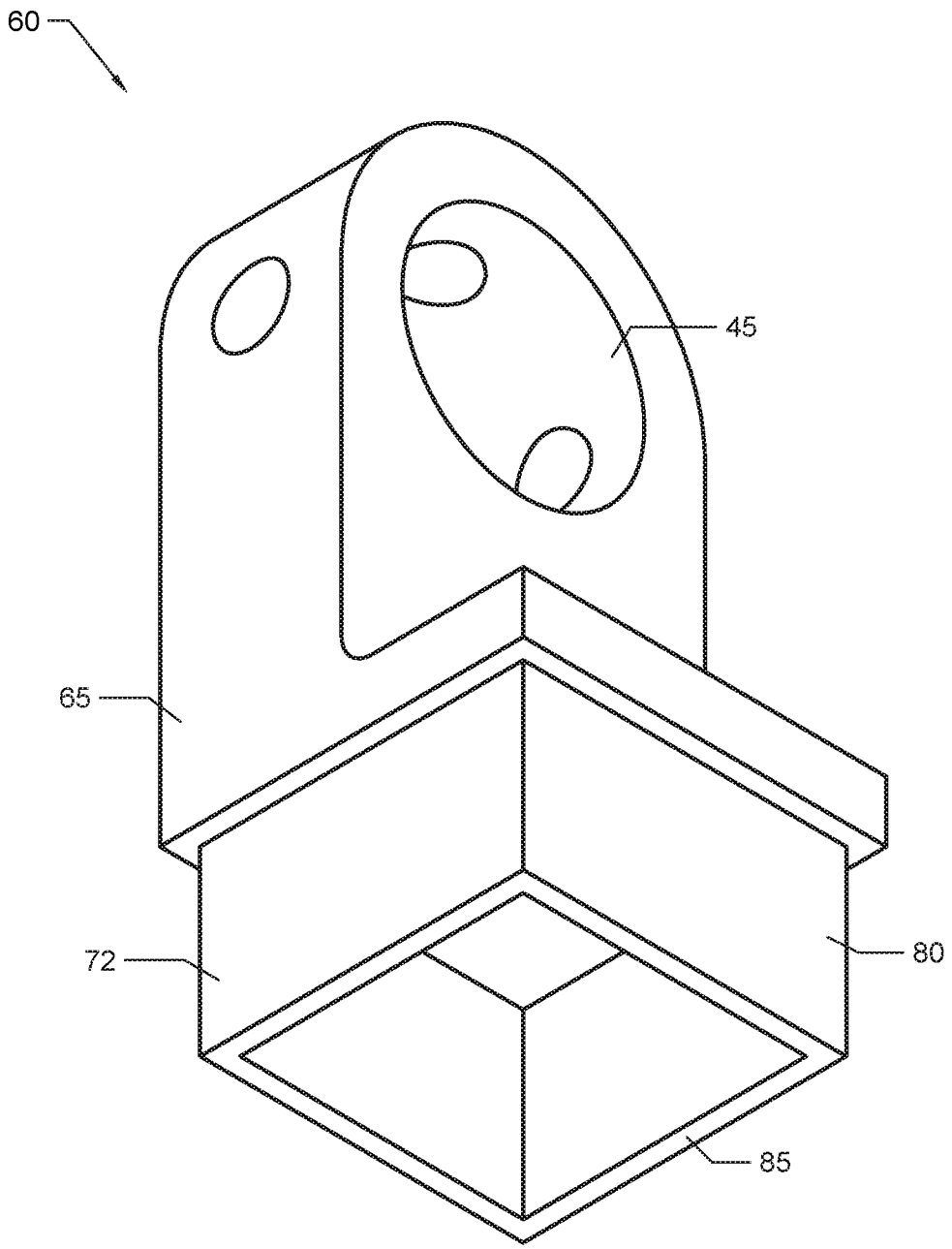
FIG. 4 is a perspective view of a pivot mount aperture cap of FIG. 3.

In an alternative embodiment, seen in FIG. 3, the telescoping legs 35 and 40 may not include a pivot mount aperture 45, but may instead include a pivot mount aperture cap 60 that is adjacent and attached to the telescoping legs 35 and 40. As seen in FIGS. 3 and 4, the pivot mount aperture cap 60 includes a telescoping leg attachment section 72, positioned below and extending downwardly from a crossbar attachment section 65. The telescoping leg attachment section 72 is preferably shaped and sized to engage with the upper end 75 of the telescoping legs 35 and 40 so that an outer surface 80 of the telescoping leg attachment section 72 abuts an inner surface (not shown) of the each telescoping leg 35 and 40. Thus, the lower rim 85 of the crossbar attachment section 65 abuts and rests on the upper rim (not shown) of the telescoping leg 35 and 40. The crossbar attachment section 65 is generally flat, and a substantially vertical member 70 extends upwardly therefrom, forming a generally "L" shape with the crossbar attachment section 65. A pivot mount aperture 45 extends through the vertical member 70. The pair of telescoping legs 10 may thereby be attached to the crossbar 15, in conjunction with the pivot mount 25 and the adjuster pin 30. In alternative embodiments, the pivot mount aperture cap 60 may be different sizes and shapes as long it is able to be inserted into and engage with the upper end 75 of the telescoping legs 35 and 40 and further includes the pivot mount aperture 45 so the crossbar 15 may be attached to the telescoping legs 35 and 40.

Figure 5:
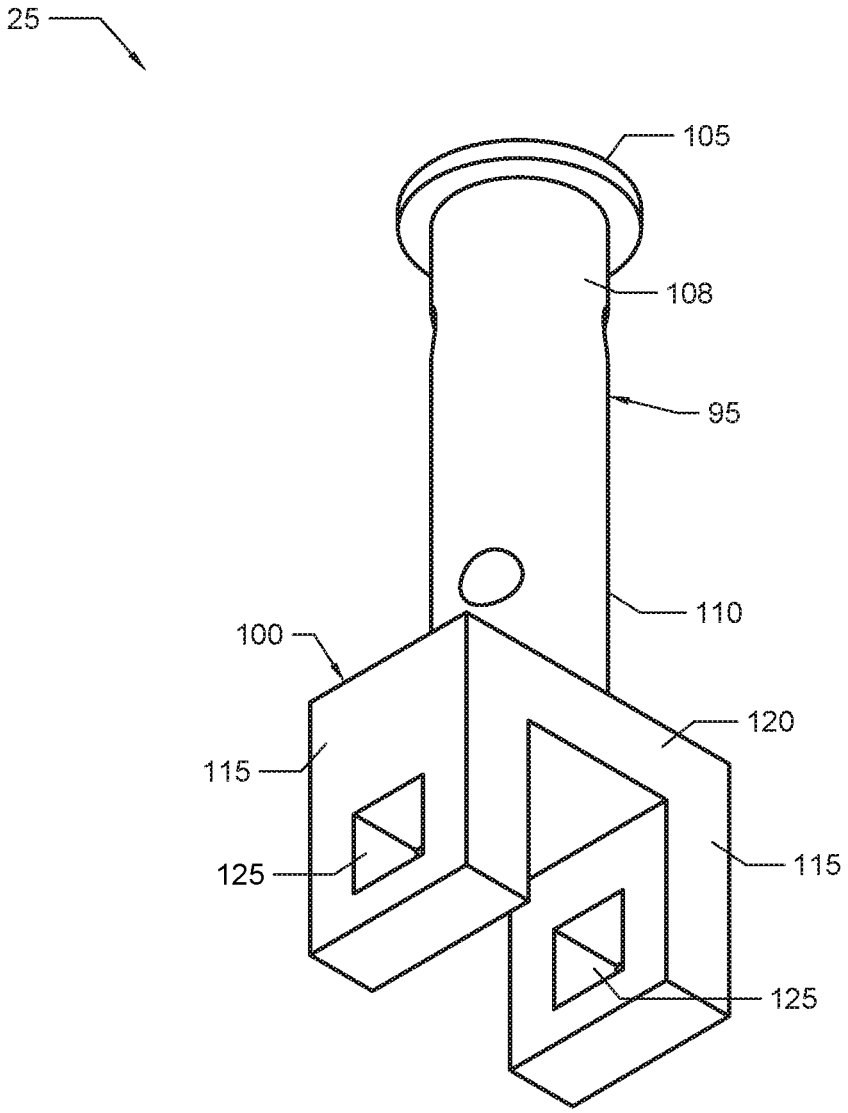
FIG. 5 is a perspective view of a pivot mount of FIGS. 1-3.

As shown in FIG. 5, the pivot mount 25 has a pivot mount cylindrical member 95 and a U-shaped component 100. The pivot mount cylindrical member 95 is preferably an elongated cylinder, and is further shaped and sized so that the pivot mount cylindrical member 95 may be threaded through the pivot mount aperture 45 of the telescoping legs 35 and 40.

The pivot mount 25 further includes a pivot mount end cap 105. The pivot mount end cap 105 is a substantially planar circle having a greater diameter than the diameter of the pivot mount aperture 45. The pivot mount end cap 105 is located and positioned at the first end 108 of the pivot mount cylindrical member 95 to prevent the telescoping legs 35 and 40 from sliding off the pivot mount cylindrical member 95.

The pivot mount cylindrical member 95 is adjacent and attached to a U-shaped component 100 at a second end 110. The U-shaped component 100 preferably includes two pivot mount arms 115, which are elongated rectangular member, adjacent and attached perpendicularly to the both ends of a pivot mount middle section 120. The pivot mount middle section 120 is an elongated rectangular member, such that the U-shaped component 100 resembles the letter "U." As illustrated in FIGS. 1-3 and 5, the pivot mount middle section 120 and pivot mount arms 115 of the U-shaped component 100 are sized and shaped so that crossbar 15 may be placed in-between the pivot mount arms 115, such that the crossbar 15 is adjacent to both the pivot mount arms 115 and pivot mount middle section 120. The pivot mount 25 therefore engages both the first end 22 and the second end 23 of the crossbar 15.

The pivot mount arms 115 of the U-shaped component 100 each further include a pivot mount square aperture 125, which are preferably sized and shaped so that adjuster pin 30 (which will be explained in more detail hereinafter) may be placed within the pivot mount square apertures 125 of the U-shaped component 100. The crossbar 15 includes square crossbar apertures (not visible in FIGS. 2 and 3) located and positioned at a first end 126 and a second end 128 of the crossbar 15. The crossbar 15 is placed in-between the arms of the U-shaped component 100 so that the pivot mount square apertures 125 and the square crossbar apertures 130 align with one another. The adjuster pin 30 can therefore thread through the crossbar 15 and the U-shaped component 100, connecting the telescoping legs 10 to the crossbar 15.

Thus, the pivot mount cylindrical member 95 of the pivot mount 25 extends into and through pivot mount aperture 45 of the telescoping legs 10. The pivot mount end cap 105 is then attached to the first end 108 of the pivot mount cylindrical member 95 by welding, gluing, or any other method known in the art. The pivot mount 25 is thus located and positioned so that the pivot mount end cap 105 is adjacent to the distal side 140 of the outer telescoping leg 40, and the U-shaped component 100 is located and positioned adjacent to the proximal side 142 of the inner telescoping leg 35. The telescoping legs 35 and 40 are therefore adjacent and in-between both the pivot mount end cap 105 and the U-shaped component 100 of the pivot mount 25, preventing the telescoping legs 35 and 40 from sliding off of the pivot mount cylindrical member 95 and further connecting the telescoping legs 35 and 40 to the crossbar 15 with an adjuster pin 30. Finally, the pivot mount 25 further includes at least one dip bar stabilization aperture 144 which extends through the pivot mount cylindrical member 95, which will be explained in detail hereinafter.

Figure 6:
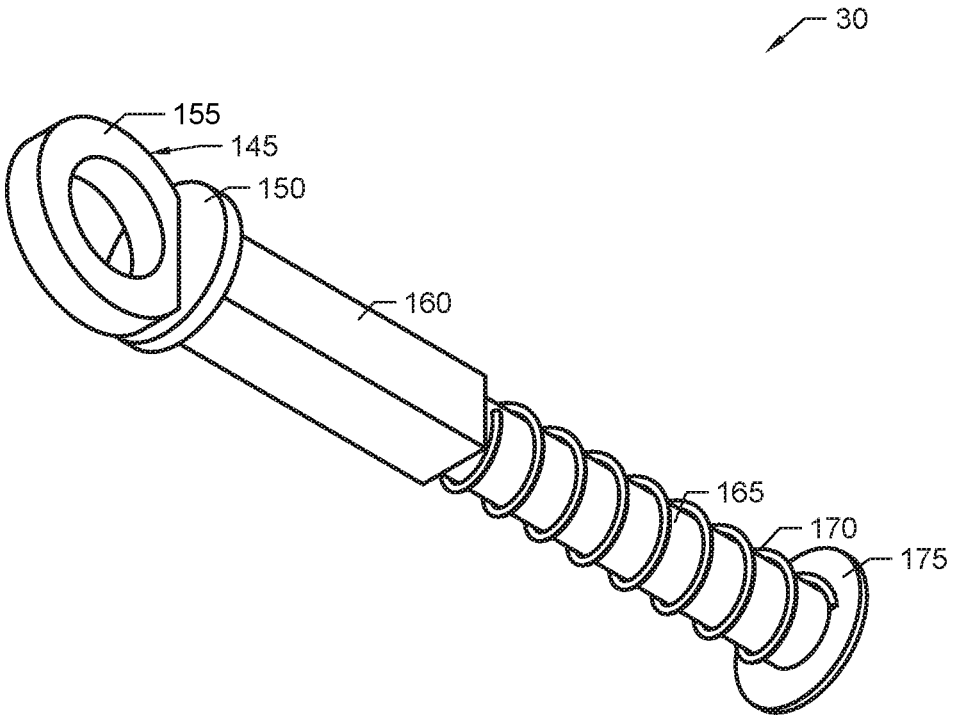
FIG. 6 is a perspective view of an adjuster pin of FIGS. 1-3.

The adjuster pin 30 is best seen in FIG. 6, and connects the pivot mount 25 and the crossbar 15. The adjuster pin 30 includes an adjuster pin handle 145 having a handle adjuster pin end cap 150 that is preferably a substantially planar circular portion. The adjuster pin handle 145 also includes an adjuster pin pull handle 155, which is preferably an annular ring adjacent and attached to the handle adjuster pin end cap 150 (as is illustrated in FIGS. 2-3 and 6). On the opposite face or side of where the adjuster pin pull handle 155 is attached to the handle adjuster pin end cap 150, an adjuster pin locking member 160 is attached to the handle adjuster pin end cap 150. The adjuster pin locking member 160 is preferably a rectangular cuboid sized and shaped to fit within the pivot mount square aperture 125 and the square crossbar aperture 85 (explained hereinafter). The adjuster pin locking member 160 is further adjacent and attached to an adjuster pin cylindrical member 165. The adjuster pin cylindrical member 165 is preferably an elongated cylinder, with a diameter substantially similar to the width of the adjuster pin locking member 160. The adjuster pin 30 further includes an adjuster pin spring 170 located and positioned around the adjuster pin cylindrical member 165, so that the adjuster pin spring 170 is a coil spring wrapped around the adjuster pin cylindrical member 165. The adjuster pin cylindrical member 165 is thus located and positioned within the center of the spiral adjuster pin spring 170.

The adjuster pin spring 170 prevents the adjuster pin locking member 160 from sliding out of the pivot mount square aperture 125 and the square crossbar aperture 85, and onto the adjuster pin cylindrical member 165. The rectangular shape and size of the adjuster pin locking member 160 prevents the adjuster pin 30 from rotating within the pivot mount square aperture 125 and the square crossbar aperture 85 and holds the pivot mount 25 and crossbar 15 in place, without allowing either the pivot mount 25 or crossbar 15 to rotate. Thus, in other embodiments, the adjuster pin locking member 160 may be other shapes, such as a hexagon, as long as it is shaped to fit and does not rotate within the pivot mount square aperture 125 and the square crossbar aperture 85. Unlike the adjuster pin locking member 160, the adjuster pin cylindrical member 165 is able to rotate within the pivot mount square aperture 125 and the square crossbar aperture 85 due to its circular shape and diameter, and therefore also allows the pivot mount 25 and crossbar 15 to rotate. As will be described in more detail hereinafter, the user is able to use the adjuster pin pull handle 155 to pull the adjuster pin 30 so that the adjuster pin spring 170 compresses due to the adjuster pin spring 170 pressed against the side of one of the pivot mount arms 115. At the same time as the adjuster pin spring 170 is being compressed, the adjuster pin locking member 160 is pulled out of the pivot mount square aperture 125 and the square crossbar aperture 85 so that the adjuster pin cylindrical member 165 is within the pivot mount square aperture 125 and the square crossbar aperture 85. The crossbar 15 can then rotate, as will be described in more detail hereinafter.

The adjuster pin 30 also includes an adjuster pin end cap 175 located and positioned adjacent to the adjuster pin cylindrical member 165, opposite from the adjuster pin locking member 160. As stated above, the adjuster pin 30 may be inserted into the pivot mount square aperture 125 and the square crossbar aperture 85, and then the adjuster pin end cap 175 may be attached by welding, gluing, or any other method known in the art, to the adjuster pin cylindrical member 165. Alternatively, if the adjuster pin end cap 175 is already attached to the adjuster pin 30, the adjuster pin handle 145 may be attached instead. Thus, the adjuster pin 30 holds the crossbar 15 within the two arms 115 of the U-shaped component 100 of the pivot mount 25.

Figure 7:
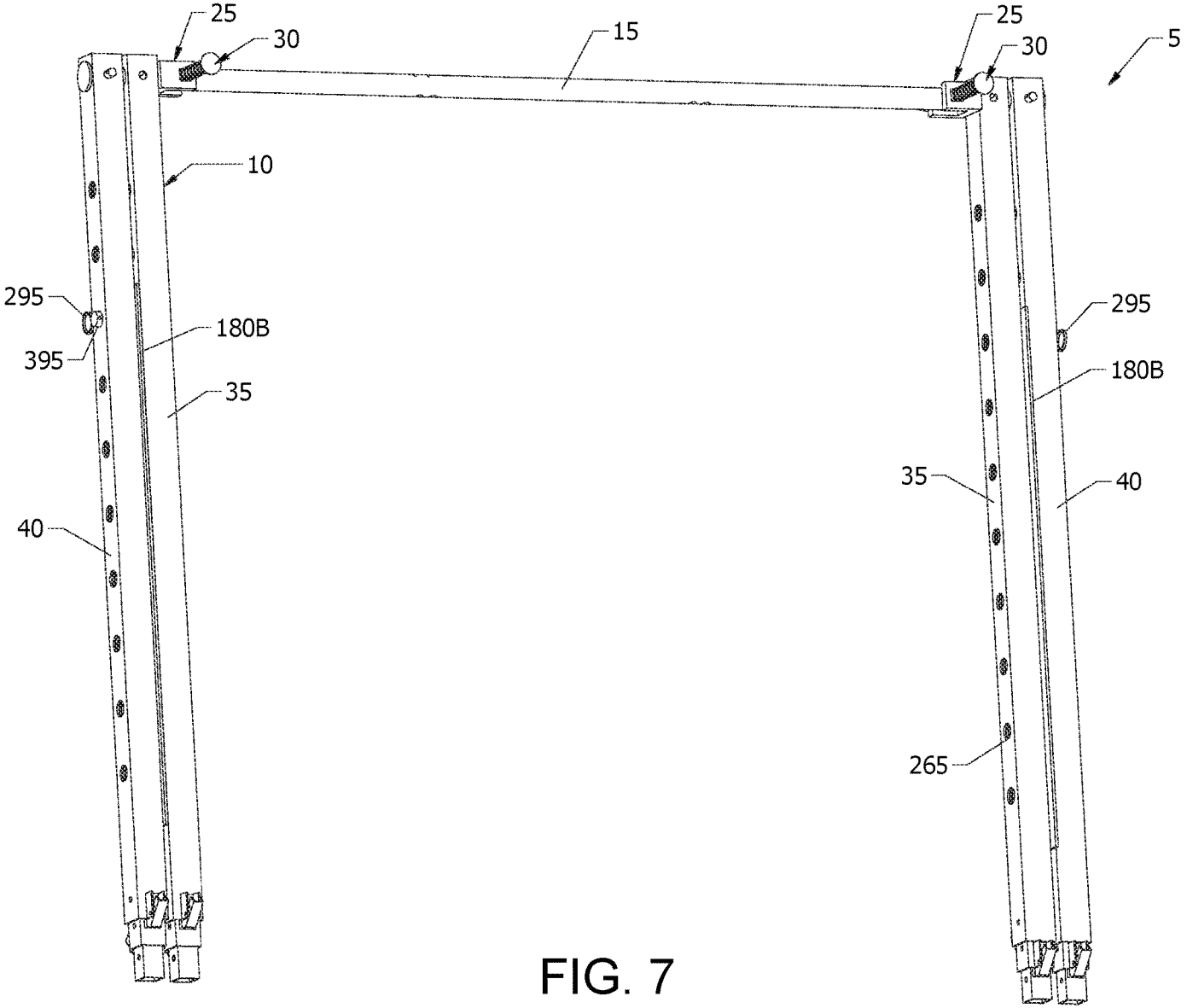
FIG. 7 is a perspective view of a first intermediate configuration to store the workout apparatus of FIG. 1.
Figure 8:
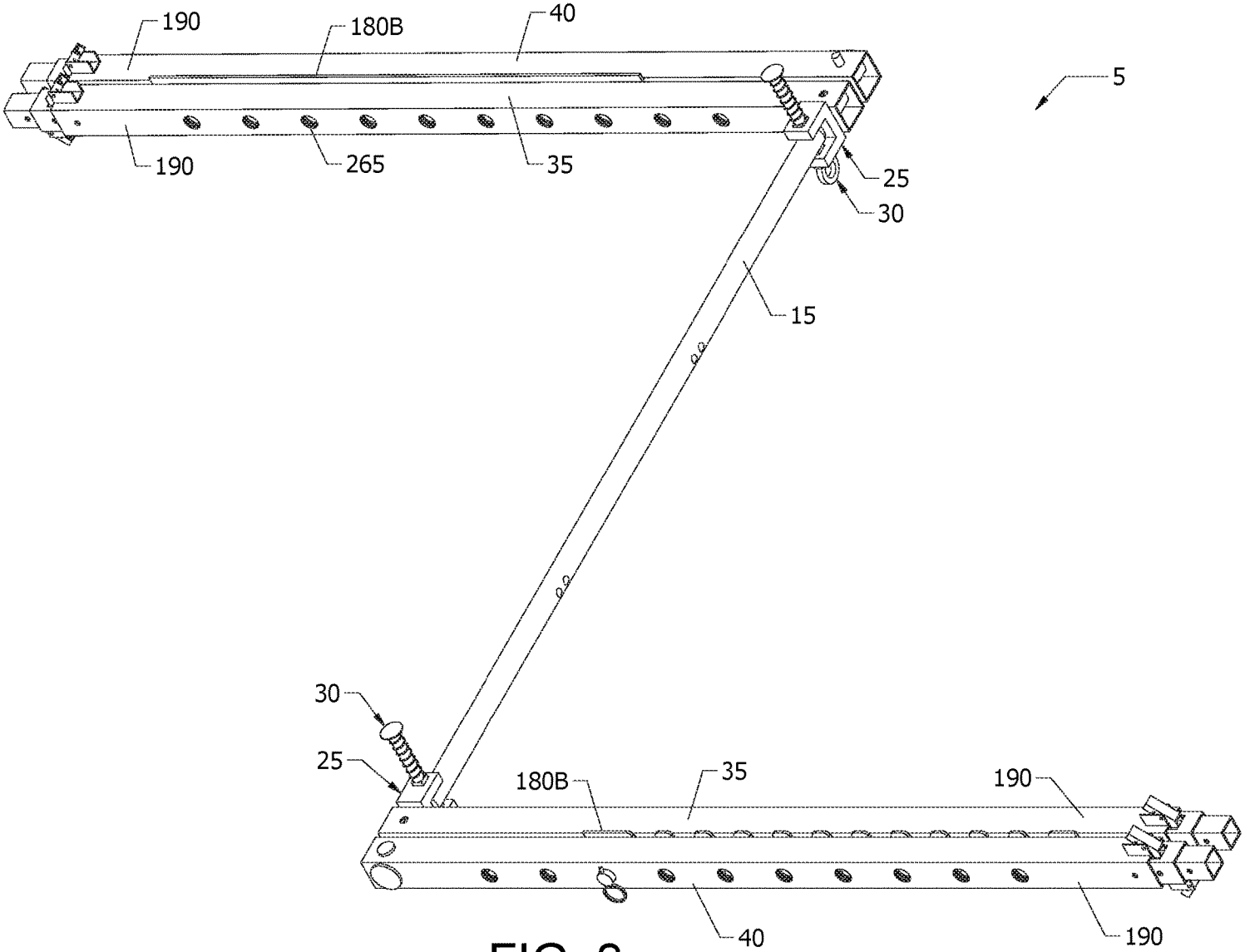
FIG. 8 is a perspective view of a second intermediate configuration to store the workout apparatus of FIGS. 1 and 7.

As seen in FIG. 7, in order to rearrange the workout apparatus 5 for storage, the workout apparatus 5 is preferably placed on the floor. A rigid link 180A is removed from a rigid link attachment protrusion 185 (as will be explained in more detail hereinafter) so that the inner and outer telescoping legs 35 and 40 are side by side and are no longer in an inverted V-shape. In other words, the telescoping legs 35 and 40 are aligned with the lateral axis of the crossbar. Next, as seen in FIG. 8, one pair of telescoping legs 10 is rotated so the lower ends 190 of telescoping legs 10 are pointed in opposite directions, where the lower ends 190 of the telescoping legs 10 are the portion of the telescoping legs 10 not adjacent to the crossbar 15. That is, one pair of telescoping legs 10 should be rotated 180 degrees around the crossbar 15, so that the workout apparatus 5 is approximately in a Z-shape.

Figure 9:
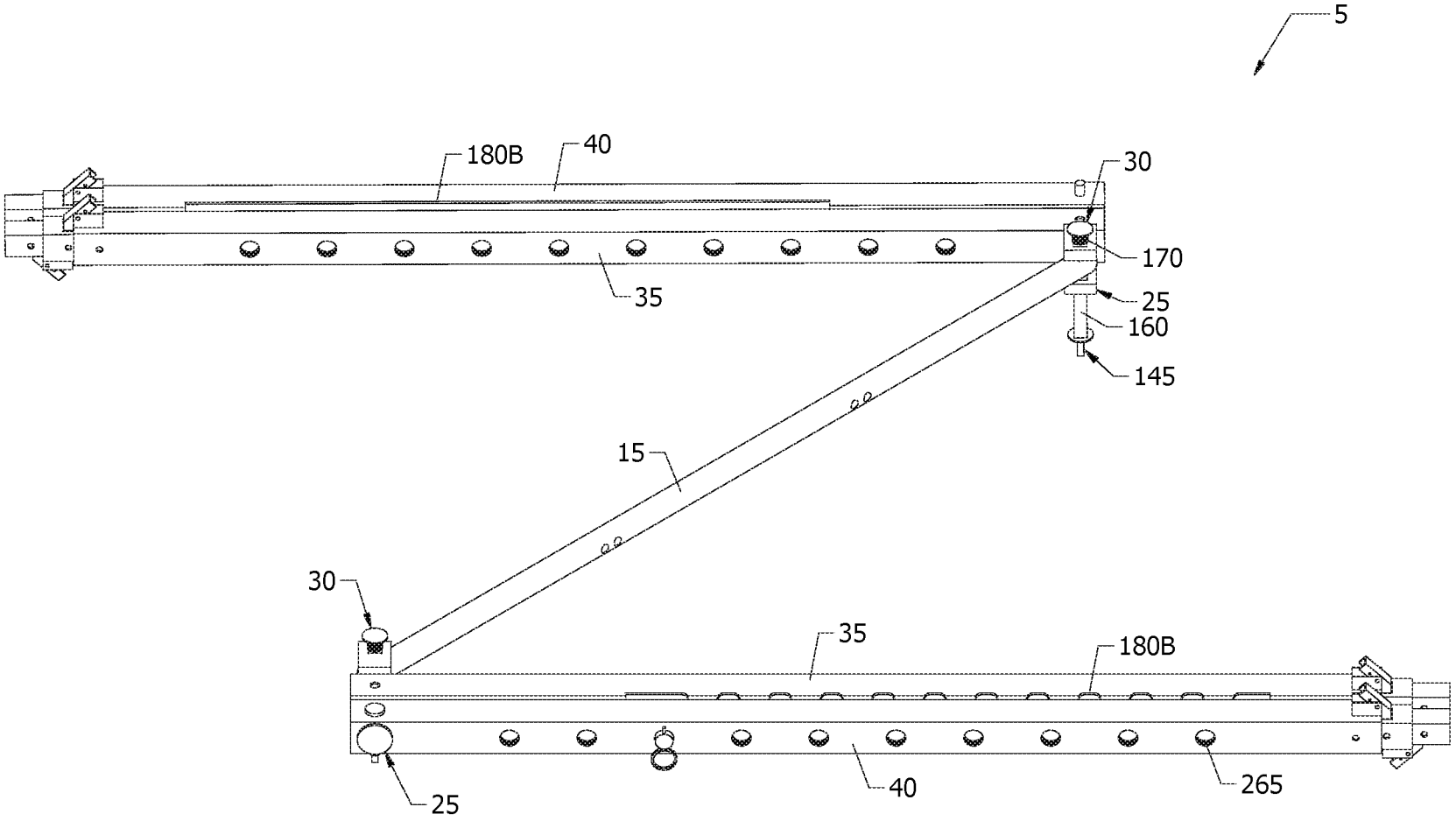
FIG. 9 is a perspective view of a third intermediate configuration to store the workout apparatus of FIGS. 1 and 7-8.
Figure 10:
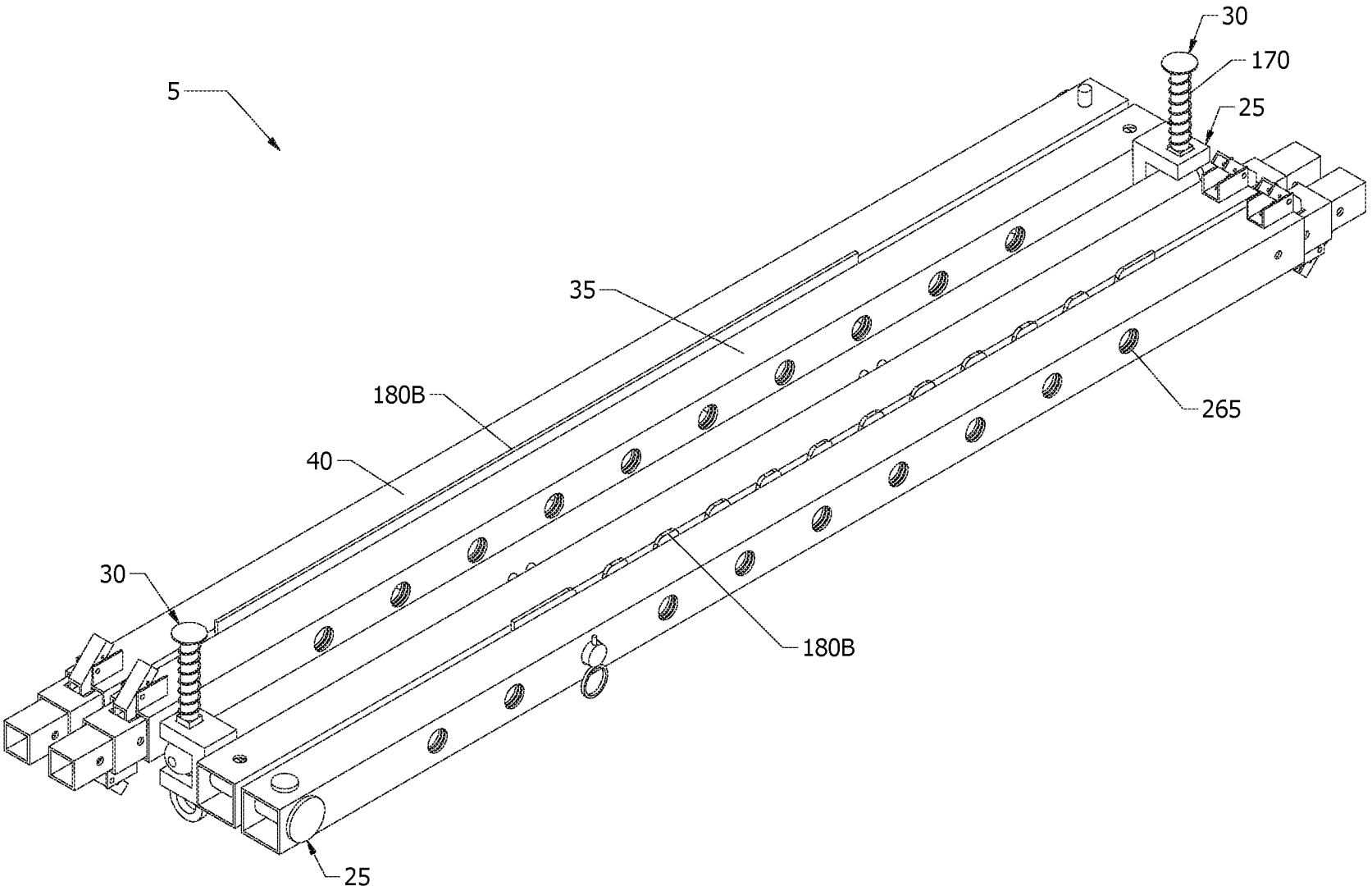
FIG. 10 is a perspective view of a fourth intermediate configuration to store the workout apparatus of FIGS. 1 and 7-9.

The adjuster pin handle 145 of the adjuster pin 30 is then pulled so that the adjuster pin locking member 160 is no longer in the pivot mount square aperture 125 or the square crossbar aperture 85. The telescoping legs 10 may thereby rotate around the crossbar 15, in both the lateral and longitudinal axis of the crossbar 15. After pulling the adjuster pin handle 145, the adjuster pin spring 170 becomes compressed and the adjuster pin cylindrical member 165 is within the pivot mount square aperture 125 and the square crossbar aperture 85, allowing the telescoping legs 10 to rotate around the crossbar 15 due to the cylindrical shape of the adjuster pin cylindrical member 165 within the rectangular pivot mount square aperture 125 and the square crossbar aperture 85. After the adjuster pin 30 has been pulled, the telescoping legs 10 should be rotated 90 degrees around the adjuster pin 30 to become parallel with the crossbar 15, rotating past the 45 degrees around the adjuster pin 30 as seen in FIG. 9. Thus, the telescoping legs 10 are rotated towards the crossbar 15 until the telescoping legs 10 are flush against the crossbar 15, and the workout apparatus 5 is folded flat, illustrated in FIG. 10. The workout apparatus 5 is therefore able to be folded into a form that is easily able to be stored and moved, as well as being able to be reassembled into a fully functional exercise machine. The workout apparatus 5 therefore has a first position, where the workout apparatus 5 is placed in a position and form where the user may use the workout apparatus 5. In the first position, in each pair of telescoping legs 10, the telescoping legs 35 and 40 are positioned so that they have an angle greater than zero between each other. Each pair of telescoping legs 10 further engages the pivot mount 25 at the first end 22 and the second end 23 of the crossbar 15, and together are able to support the crossbar 15. The workout apparatus 5 further has a second position where the workout apparatus 5 has been placed in in a form appropriate for storage. In the second position, the workout apparatus 5 has each pair of telescoping legs 10, or telescoping legs 35 and 40, adjacent to the crossbar and positioned within the longitudinal plane of the crossbar.

Figure 11:
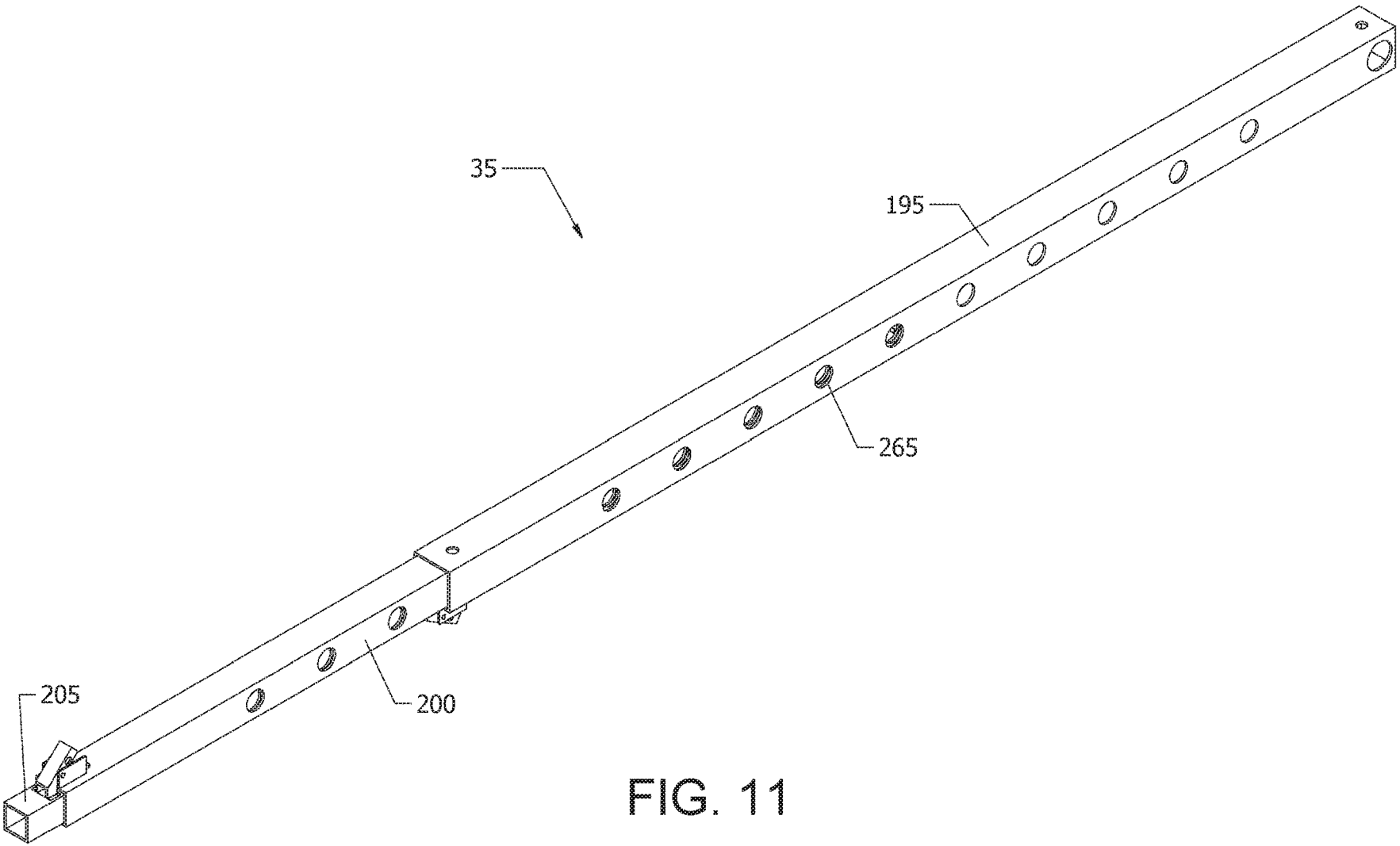
FIG. 11 is a perspective view of a telescoping leg of FIGS. 1-3 and 7-10.
Figure 22:
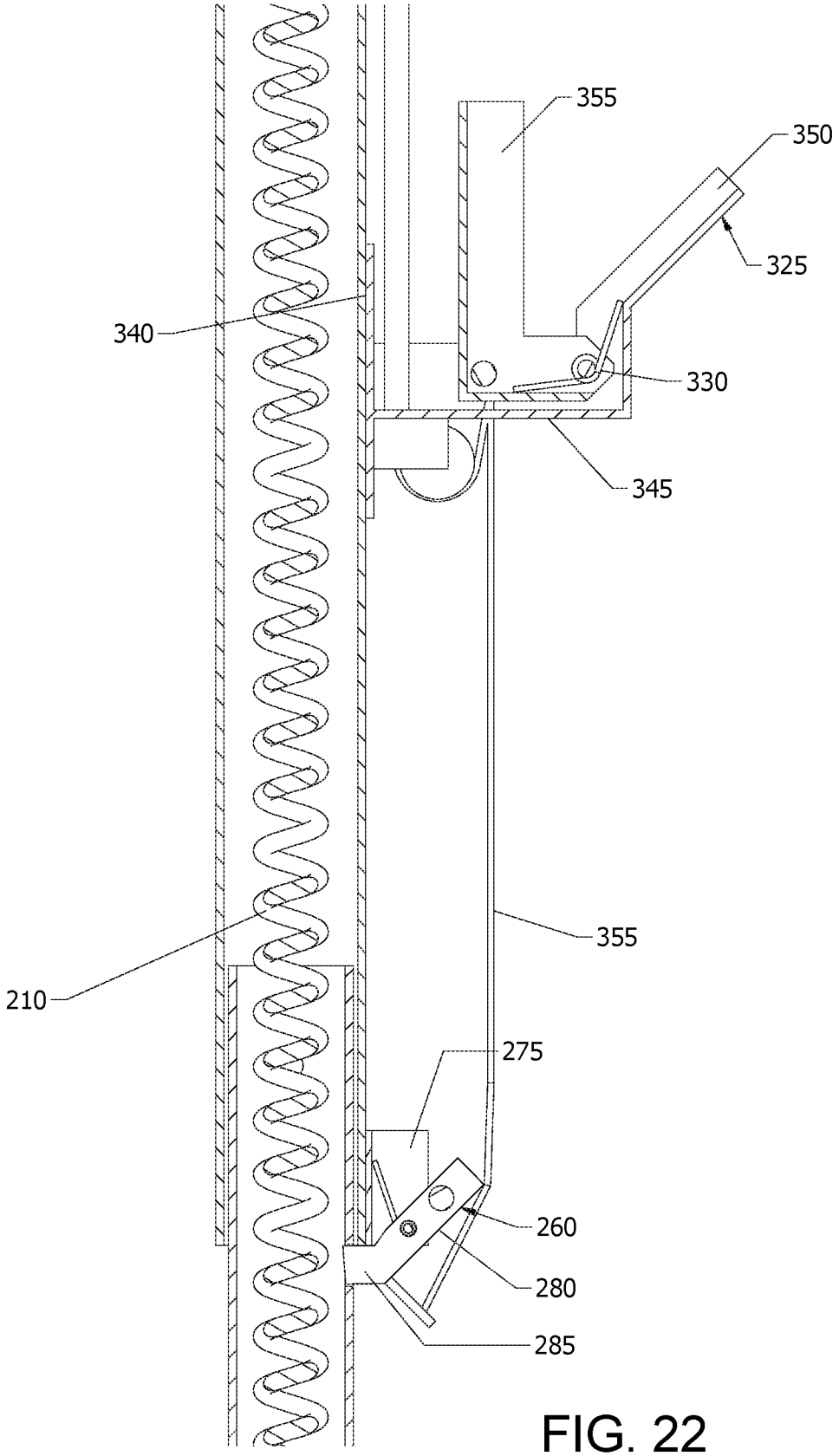
FIG. 22 is an enlarged cross section view of the spring telescoping leg with a hand actuated controller of FIGS. 19-21.

In addition to the workout apparatus 5 being able to be placed in a form convenient for storage, the workout apparatus 5 may also be adjusted to suit a user's height and preferences through its telescoping legs 10. Each telescoping leg 35 and 40 includes at least two leg sections, which allows the height of the workout apparatus 5, and thus the crossbar 15, to be adjusted. As seen in FIG. 11, in one embodiment of the workout apparatus 5, the inner and outer telescoping legs 35 and 40 each include an upper section 195, an intermediate section 200, and a lower section 205. The upper section 195, intermediate section 200, and lower section 205 are preferably all hollow rectangular cuboids, however the upper section 195, intermediate section 200, and/or the lower section 205 may be any other shape that allows for a telescoping movement. In alternative embodiments, the telescoping legs 10 may include springs 210, which may be used to offset the weight of the telescoping legs 35 and 40 so that the height of the telescoping legs 35 and 40 are easier to adjust and is shown in FIG. 22.

Figure 12:
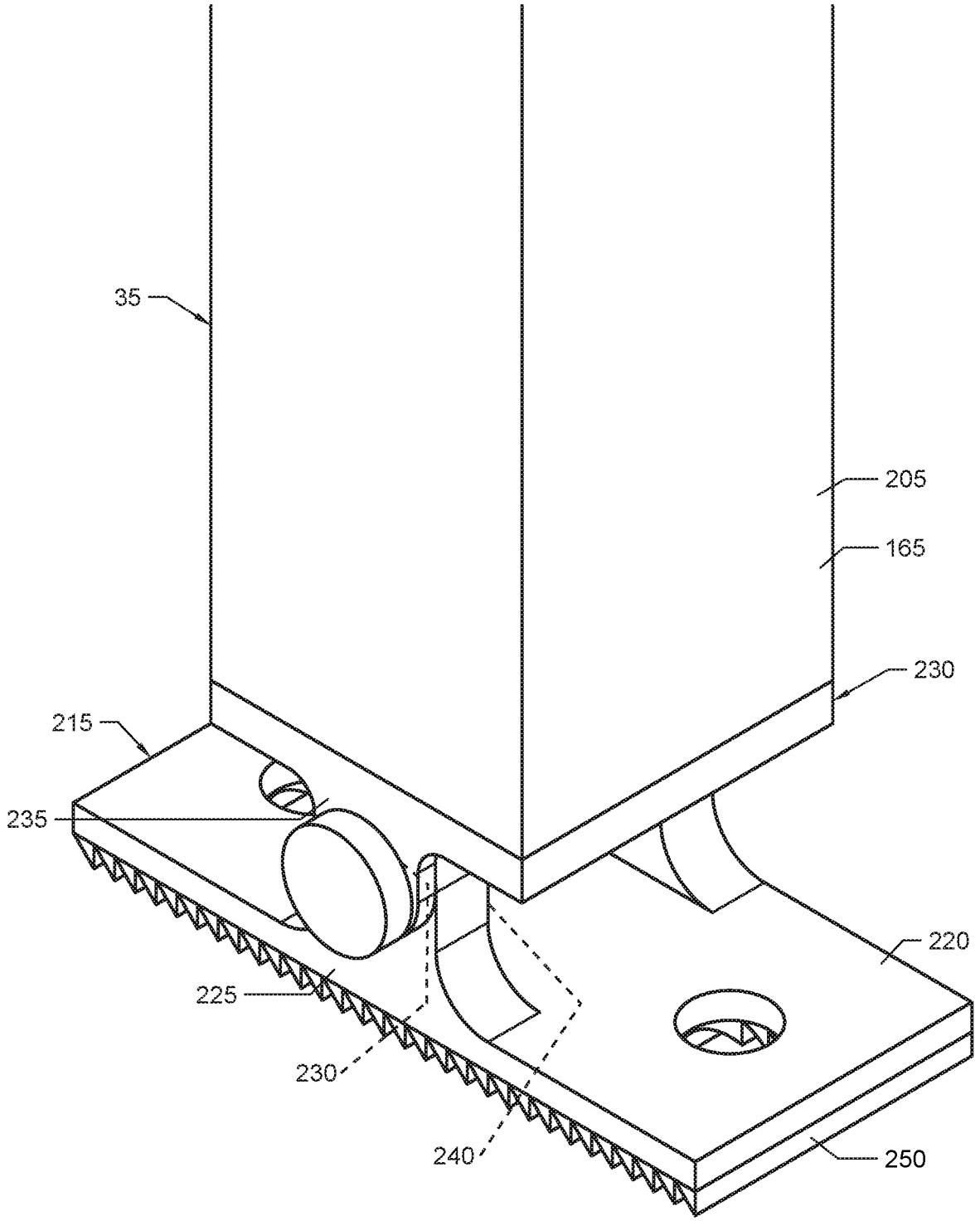
FIG. 12 is an enlarged perspective view of a first embodiment of the telescoping leg of FIG. 11 and a rubber foot.
Figure 13:
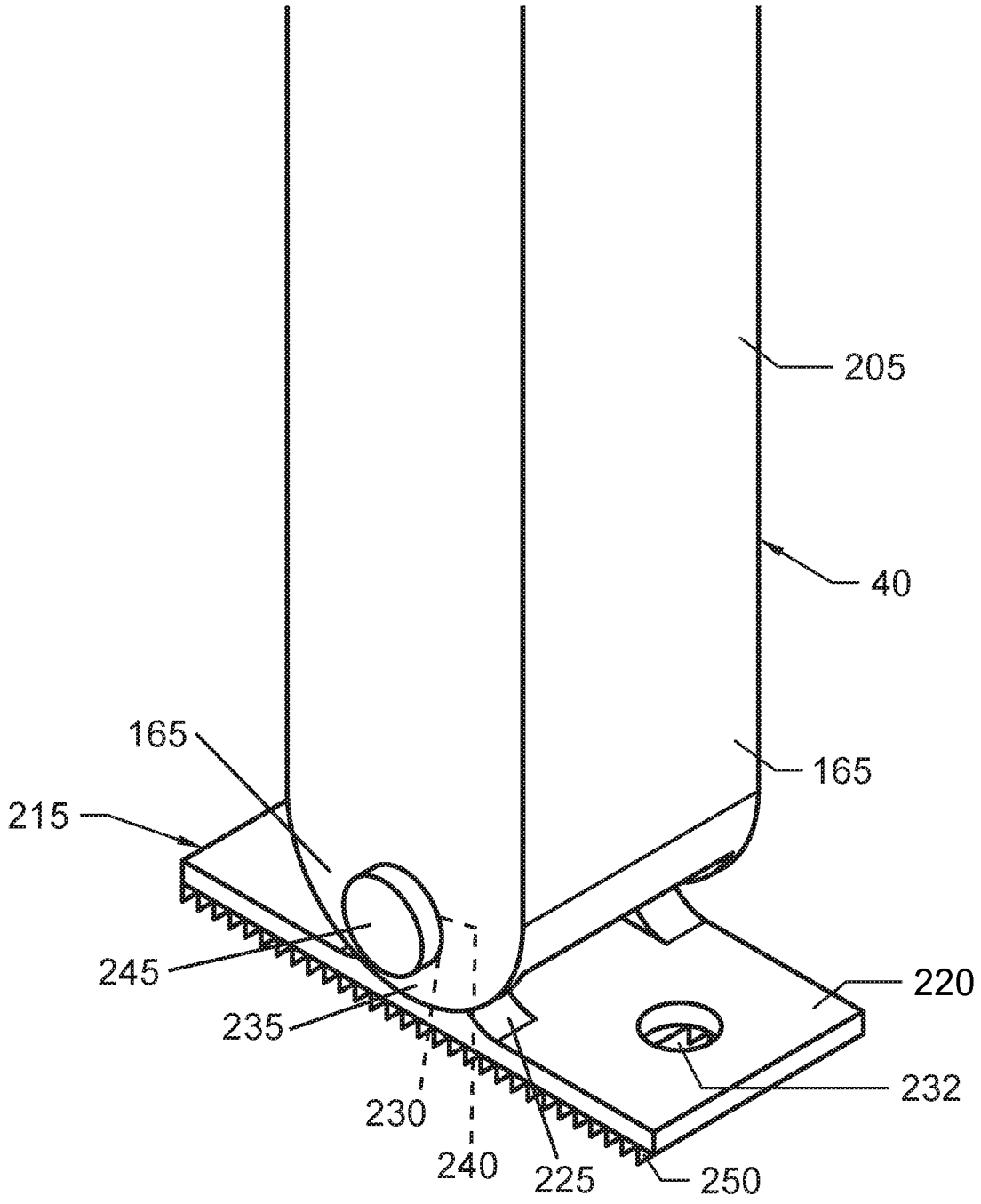
FIG. 13 is an enlarged perspective view of an alternative embodiment of the telescoping leg and the rubber foot from FIG. 11.

The lower section 205 may include a rubber foot 215 as seen in FIGS. 12 and 13. In the embodiments including the rubber foot 215, the rubber foot 215 may be located and positioned at the lower end 165 of the telescoping leg 35 and/or 40. The rubber foot 215 includes a planar member 220 and at least one telescoping leg attachment section 225, each of which further includes a telescoping leg aperture 230. The planar member 220 is preferably a substantially planar member adjacent and attached to the telescoping leg attachment sections 225, which may further include a rubber foot aperture 232 that can be used to secure the rubber foot 215 to the ground for increased stability. Each telescoping leg attachment section 225 is preferably located and positioned on an opposite end of the lateral sides of the planar member 220, and extends upwards from the planar member 220 towards the crossbar 15.

In embodiments including the rubber foot 215, the two sides of the lower end 165 of the lower section 205 may include a foot attachment section 235. The two sides of the telescoping leg 35 extend downward from its lower section 205 towards the rubber foot 215. The foot attachment sections 235 of the telescoping leg 35 or 40 may be substantially similar to the telescoping leg attachment sections 225, and each further includes a foot attachment aperture 240. The foot attachment aperture 240 and foot attachment sections 235 corresponds with the telescoping leg aperture 230 and telescoping leg attachment section 225, respectively. A bolt 245 may be placed into and extend through both the telescoping leg aperture 240 and the foot attachment aperture 225, thereby attaching the telescoping leg 35 and/or 40 to the rubber foot 215 through a rotatable connection. Other methods of attaching the rubber foot 215 to the telescoping leg 35 and/or 40 are envisioned and foreseeable. This allows the rubber foot 215 to rotate and remain parallel to the floor despite the positioning and angling of the telescoping legs 35 and/or 40. The rubber foot 215 may further include a rubber pad 250 preventing the workout apparatus 5 from sliding on the floor. The telescoping leg 35 and 40 may therefore be placed at various angles, but still maintain a stable surface for the workout apparatus 5 due to combination of the bolt 245 and the rubber foot 215.

Figure 14:
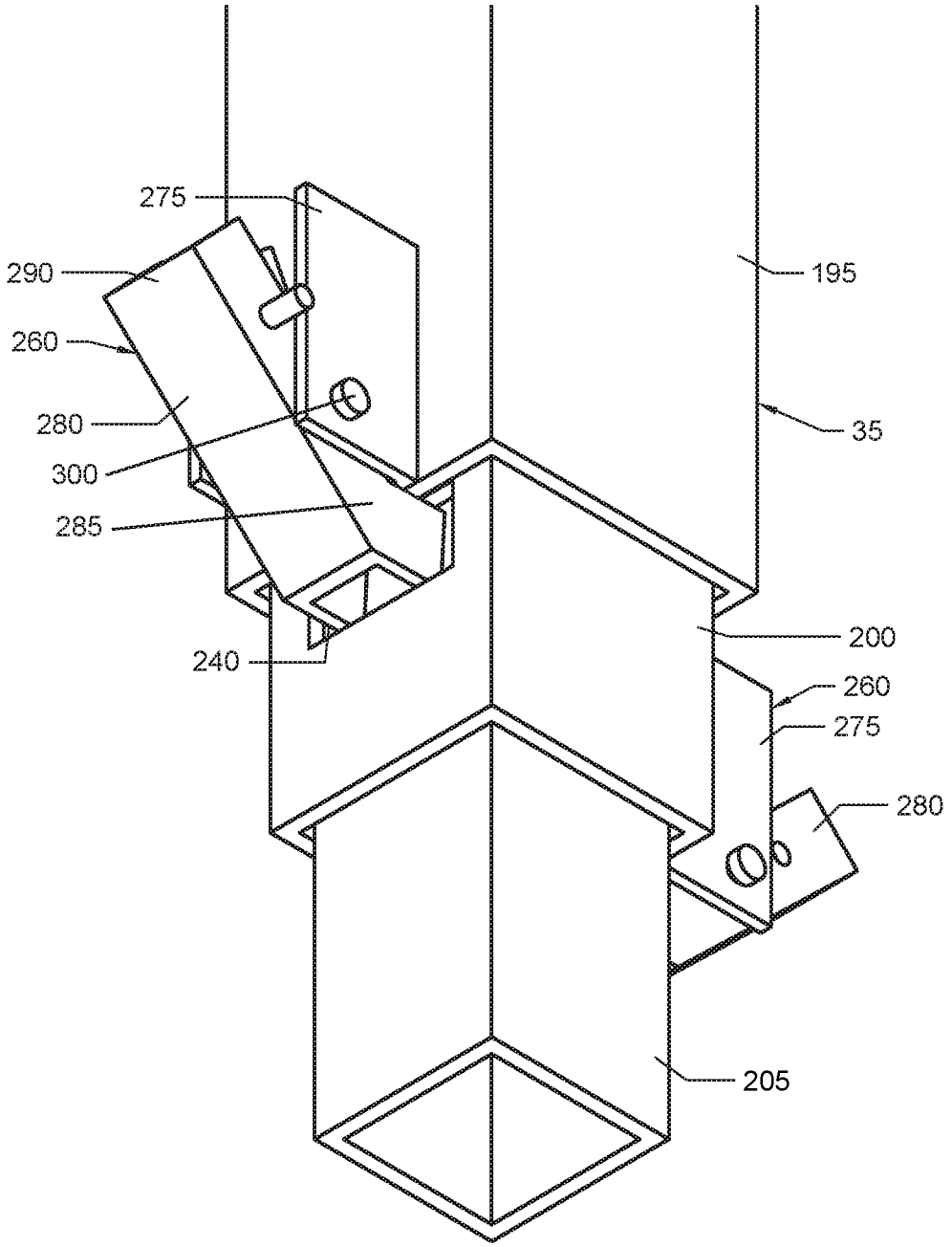
FIG. 14 is a perspective view of the telescoping leg of FIGS. 1 and 7-13 in a locked position.
Figure 15:
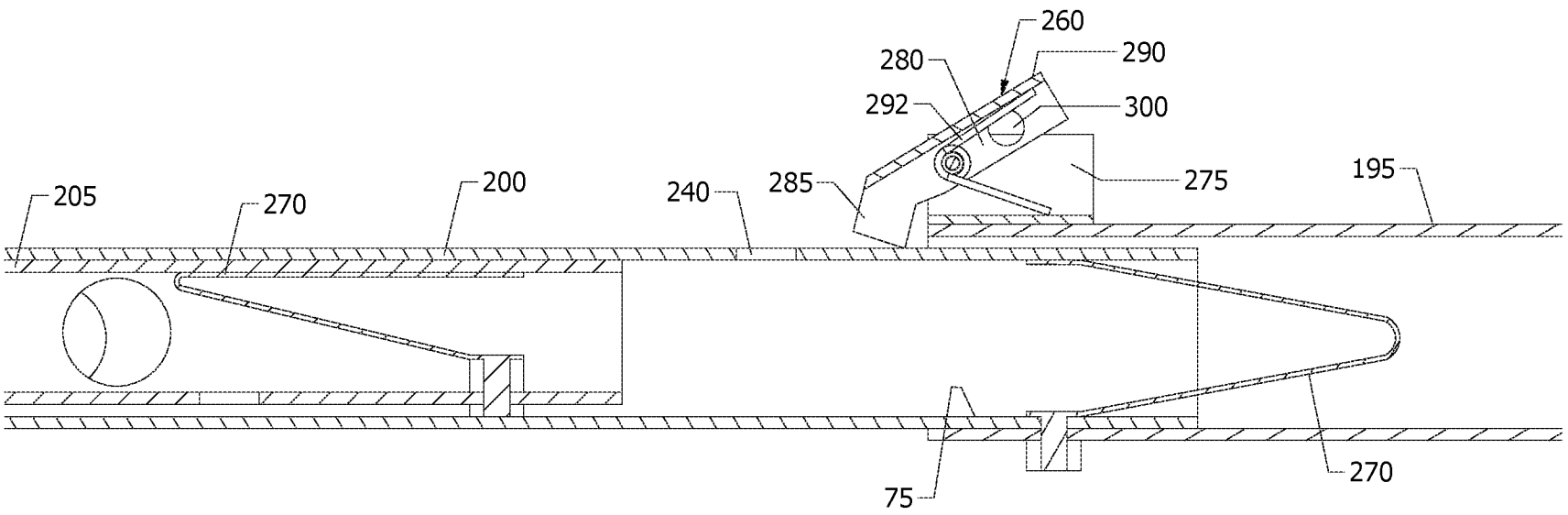
FIG. 15 is a cross section view of an inner section and an outer section of the telescoping leg of FIGS. 1 and 7-14.

As can be seen in FIGS. 14 and 15, intermediate section 200 and lower section 205 include a series of telescoping leg apertures 240, which may be rectangular apertures preferably positioned at regularly spaced intervals. Telescoping leg apertures 240 work in conjunction with a slide locking mechanism 260 to hold each telescoping leg section in place. In alternative embodiments, the telescoping leg apertures 240 may be any appropriate size and shape for accepting a lock leg section (discussed below) therein. In embodiments with one or more intermediate leg sections 200, more than one slide locking mechanism 260 may be used. In embodiments with multiple slide locking mechanisms 260, the slide locking mechanisms 260 may be located on the same side, with appropriate tolerances, but are preferably located on opposite sides of the leg sections to prevent the slide locking mechanism 260 from obstructing the movement of the other leg sections. However, in alternative embodiments, the slide locking mechanism 260 may be located and positioned on both sides of the leg sections, across from each other, to selectively restrict free movement in either direction. In one embodiment, all of the leg sections further include a series of circular apertures 265 (as seen in FIGS. 1-2 and 7-11), and one of the telescoping legs 35 or 40, in a pair of telescoping legs 10, may additionally include a substantially cylindrical protrusion with a head (not shown), which may both be used in conjunction to secure the rigid link 180B for added stability to the workout apparatus 5, which will be discussed in greater detail hereinafter.

The width and depth of the intermediate section 200 is slightly less than the width and depth of the upper section 195, so that the intermediate section 200 may be nested within the upper section 195. Likewise, the width and depth of the lower section 205 is also slightly less than the width and depth of the intermediate section 200, so that the lower section 205 may be nested within the intermediate section 200. Thus, the upper section 195, intermediate section 200, and lower section 205 of the telescoping legs 35 and 40 allow the user to adjust the height of the workout apparatus 5 by the intermediate section 200 sliding vertically within the upper section 195. Similarly, the lower section 205 can also slide vertically within the intermediate section 200, thereby further adjusting the height of the telescoping legs 10.

In one embodiment, as seen in FIG. 15, the telescoping legs 35 and 40 include a V-shaped clip 270 in-between each leg section, 195 and 200, as well as 200 and 205, of the telescoping legs 35 and 40. The V-shaped clip 270 prevents the intermediate section 200 or the lower section 205 from sliding out and becoming detached from the upper section 195 or intermediate section 200, respectively. In another embodiment, the telescoping legs 35 and 40 may include a string within the legs sections 195 and 200 and/or 200 and 205 to prevent the legs sections from becoming detached from one another due to length of the string. The length of the string is sized to allow the leg sections extend to their full length without overextending. Other methods known the art may be used to prevent the leg sections 195, 200, and 205 from becoming detached from one another.

The slide locking mechanism 260 allows the telescoping legs 10 to extend or retract, thus adjusting the height of the workout apparatus 5 and, therefore, the height of the crossbar 15. Once the intermediate section 200 and/or lower section 205 have been adjusted so that the crossbar 15 is at the preferred height, the slide locking mechanism 260 may be used to prevent the height of the telescoping legs from being further adjusted. The slide locking mechanism 260 preferably includes a lock base section 275, a lock lever section 280, and a lock leg section 285, as seen in FIGS. 14 and 15.

In one embodiment, the lock base section 275 may include two substantially planar parallel sheets where lock lever section 280 may be located and positioned in-between and hingedly attached to the lock base section 275. Thus, the lock base section 275 allows the lock lever section 280 and lock leg section 285 to hingedly attach to an outer leg section and the lock leg section 285 to selectively engageable with an inner leg section. The term "inner leg section" may be defined as the intermediate section 200 when the term "outer leg section" is defined as the upper section 195. Similarly, the term "inner leg section" may be defined as the lower section 205 when the term "outer leg section" is defined as the intermediate section 200. The lock lever section 280 is adjacent and attached to the lock leg section 285. The lock lever section 280 and lock leg section 285 preferably form an obtuse angle.

Each leg section 195, 200, and 205 has a upper end 75 and a lower end 165, where the upper end 75 is located closer to the crossbar 15 and the lower end 165 located closer to the floor. The lock base section 275 is preferably attached on the lower end 165 of the outer leg section so that when the inner leg section is nested within the outer leg section, the lock leg section 285 may engage the telescoping leg apertures 240 on the inner leg section.

The proximal end 290 of the lock lever section 280 is located and positioned closer to the crossbar 15. When the user desires to shorten the height of the workout apparatus 5, the user depresses a proximal end 290 of the lock lever section 280, such that the lock leg section 285 disengages from one of the telescoping leg aperture 240. Thus, the user may continue to depress the proximal end 290 of the lock lever section 280 and adjust the telescoping legs 10 so that the inner leg section is nested further within the outer leg section. When the user releases the lock lever section 280, the lock leg section 285 engages one of the telescoping leg apertures 240 due to a torsional spring 292 of the slide locking mechanism 260. The torsional spring 292 biases the lock leg section 285 towards the inner leg section so that lock leg section 285 is either adjacent and abuts the inner leg section or engages with one of the telescoping leg apertures 240 if the lock leg section 285 aligns with one of the telescoping leg apertures 240. However, in alternative embodiments, the torsional spring 292 may be located on the outside of the slide locking mechanism 260. In other embodiments, a compression spring may be used instead of a torsional spring 292.

On the other hand, if the user desires to extend the telescoping legs 10, the user may simply raise the telescoping legs 10 and allow the nested inner leg section to slide out of the outer leg section due to the lock leg section 285 being pushed outwards from the telescoping leg aperture 240 by the wall of the inner leg section and its weight. The torsional spring 292 is preferably only strong enough to bias the lock leg section 285 towards the inner leg section and is not strong enough to able to force the lock leg section 285 to remain in the telescoping leg aperture 240. Thus, when the telescoping legs 10 is lifted, the inner leg section of a telescoping leg 35 or 40 preferably automatically slides out of its outer leg section because of its weight until the lock leg section 285 reaches the next telescoping leg aperture 240, whereas the torsion spring 292 forces the lock leg section 285 into the next telescoping leg aperture 240. The telescoping legs 10 can continue to extend until the user prevents the inner leg section from sliding out or the telescoping leg reaches its maximum extension due to the V-shaped clip 270.

Figure 16:
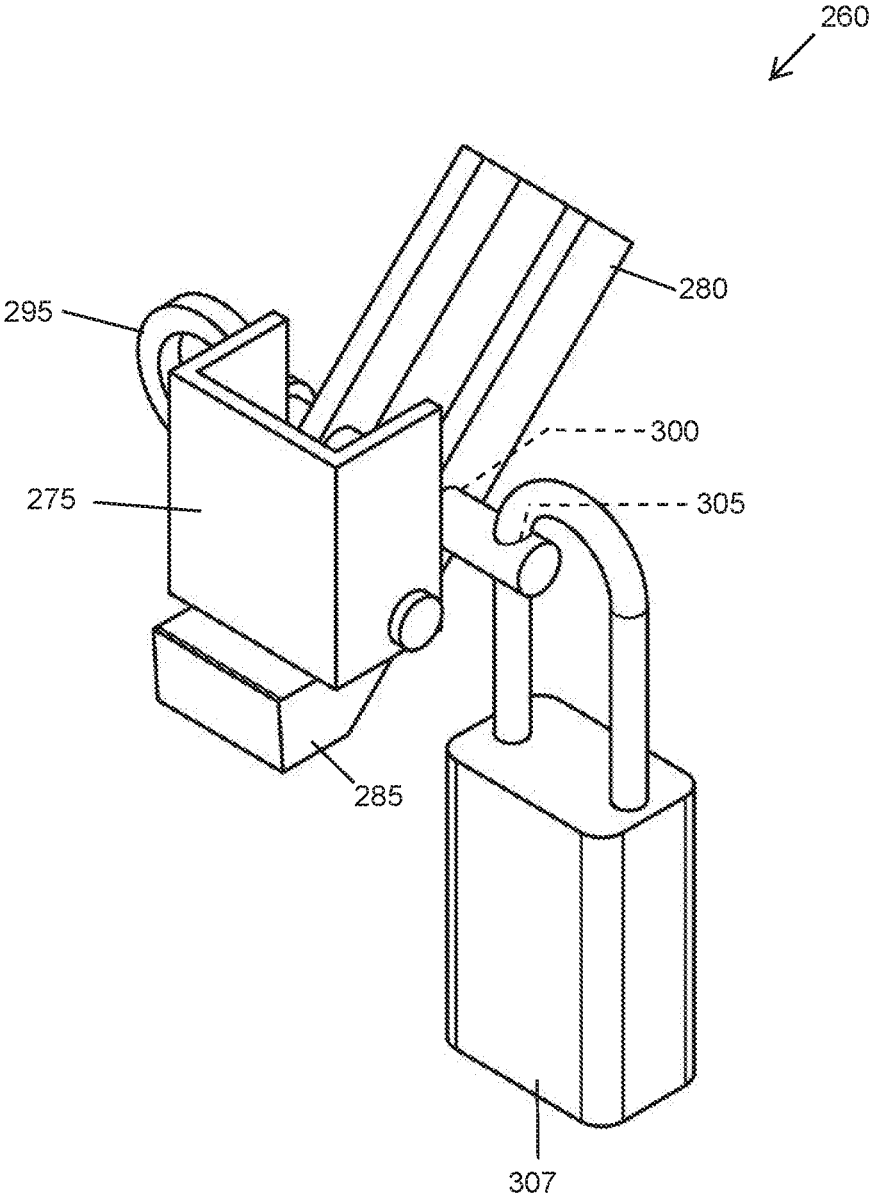
FIG. 16 is a perspective view of the sliding lock mechanism of FIG. 15 locked with a safety pin.

In order to prevent the height of the workout apparatus 5 from inadvertently changing, the user may insert a safety pin 295 into a leg height safety aperture 300 as shown in FIG. 16. Once the safety pin 295 has been inserted into the leg height safety aperture 300, the lock lever section 280 cannot be moved, and thus the lock leg section 285 cannot be disengaged from the telescoping leg aperture 240. The height of the telescoping legs 10, therefore, cannot change while the safety pin 295 has been inserted into the leg height safety aperture 300. The safety pin 295 may include a lock aperture 305, so that the user can insert a lock 307 into and through lock aperture 305 to prevent a person from removing the safety pin 295 and thereby also preventing a person from changing the height of the workout apparatus 5.

Figure 17:
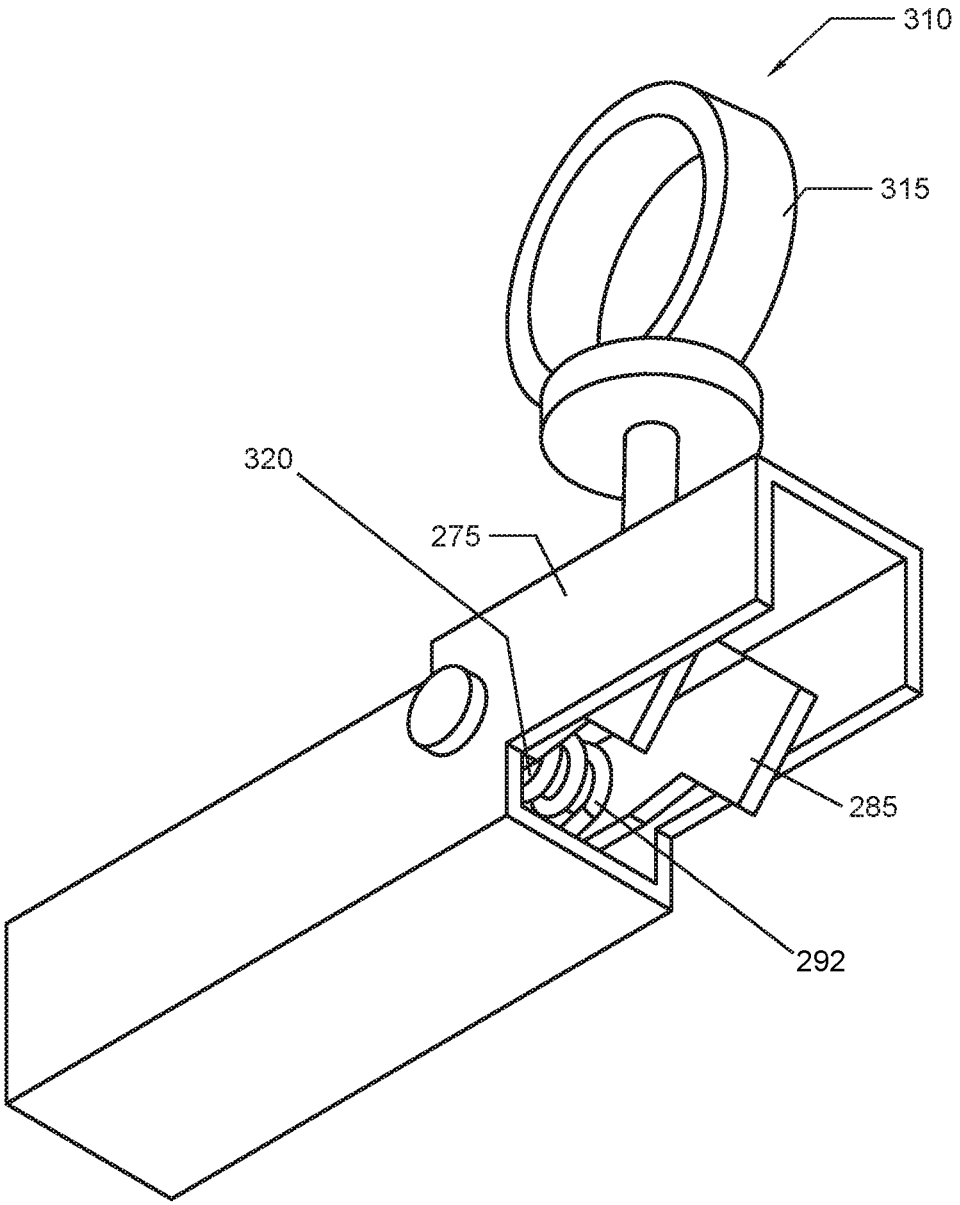
FIG. 17 is a perspective view of a pull tab slide locking mechanism in a released position.
Figure 18:
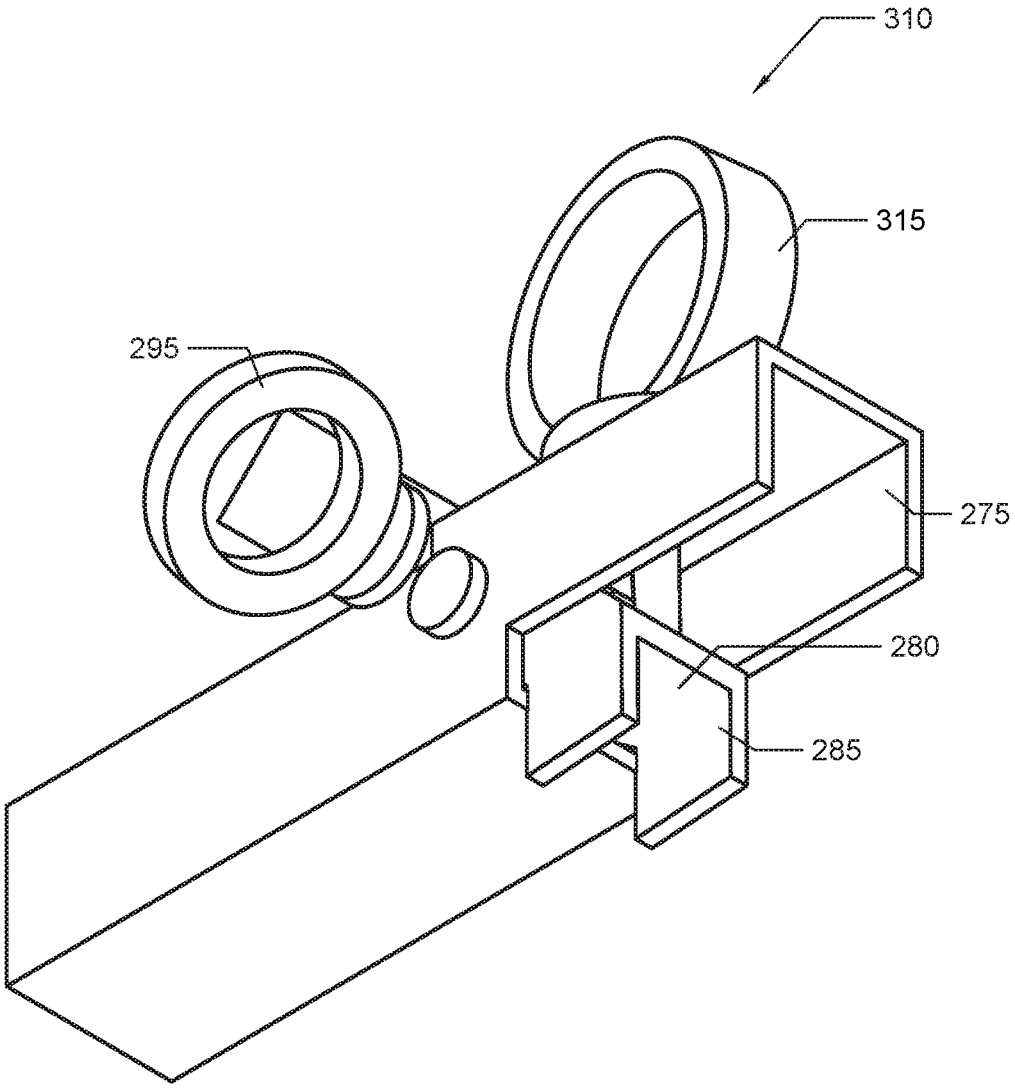
FIG. 18 is a perspective view of the pull tab slide locking mechanism of FIG. 17 in a locked position.

Similarly, in a second embodiment, the telescoping legs 35 and 40 may be adjusted through another variation of the slide locking mechanism 260, a pull tab slide locking mechanism 310, illustrated in FIGS. 17 and 18. Instead of depressing the proximal end 290 of the lock lever section 280 to disengage the lock leg section 285, the user may pull a pull tab handle 315 to disengage the lock leg section 285, as seen in FIG. 17. In greater detail, similarly to the slide locking mechanism 260, the pull tab slide locking mechanism 310 includes a lock base section 275, adjacent and attached to an outer leg section of the workout apparatus 5. The pull tab slide locking mechanism 310 further includes a lock lever section 280 and lock leg section 285, attached to one another to create an obtuse angle, and are both hingedly attached to the lock base section 275. The lock leg section 285 is also attached to the pull tab handle 315, which may be any member that allows a user to adjust the lock leg section 285. Therefore, when the pull tab handle 315 is pulled, the lock leg section 285 is also pulled back away from the telescoping leg 35, allowing the adjacent and attached lock lever section 280 to rotate towards the outer leg section. In other words, when the pull tab handle 315 is pulled, the selectively engageable lock leg section 285 is disengaged from the telescoping leg aperture 240. When the lock leg section 285 is disengaged from the telescoping leg aperture 240, the user may adjust the height of the telescoping legs 35 and 40. Once the user finishes adjusting the height of the telescoping legs 35 and 40, the user may release the pull tab handle 315, so that the torsional spring 320 biases the lock leg section 285 back towards the telescoping leg or engages with the telescoping leg aperture 240 when the lock leg section 285 aligns with the telescoping leg aperture 240 illustrated in FIG. 18. As in the slide locking mechanism 260, the pull tab slide locking mechanism 310 may also be locked and prevented from adjusting the telescoping legs 10 through the safety pin 295.

Figure 19:
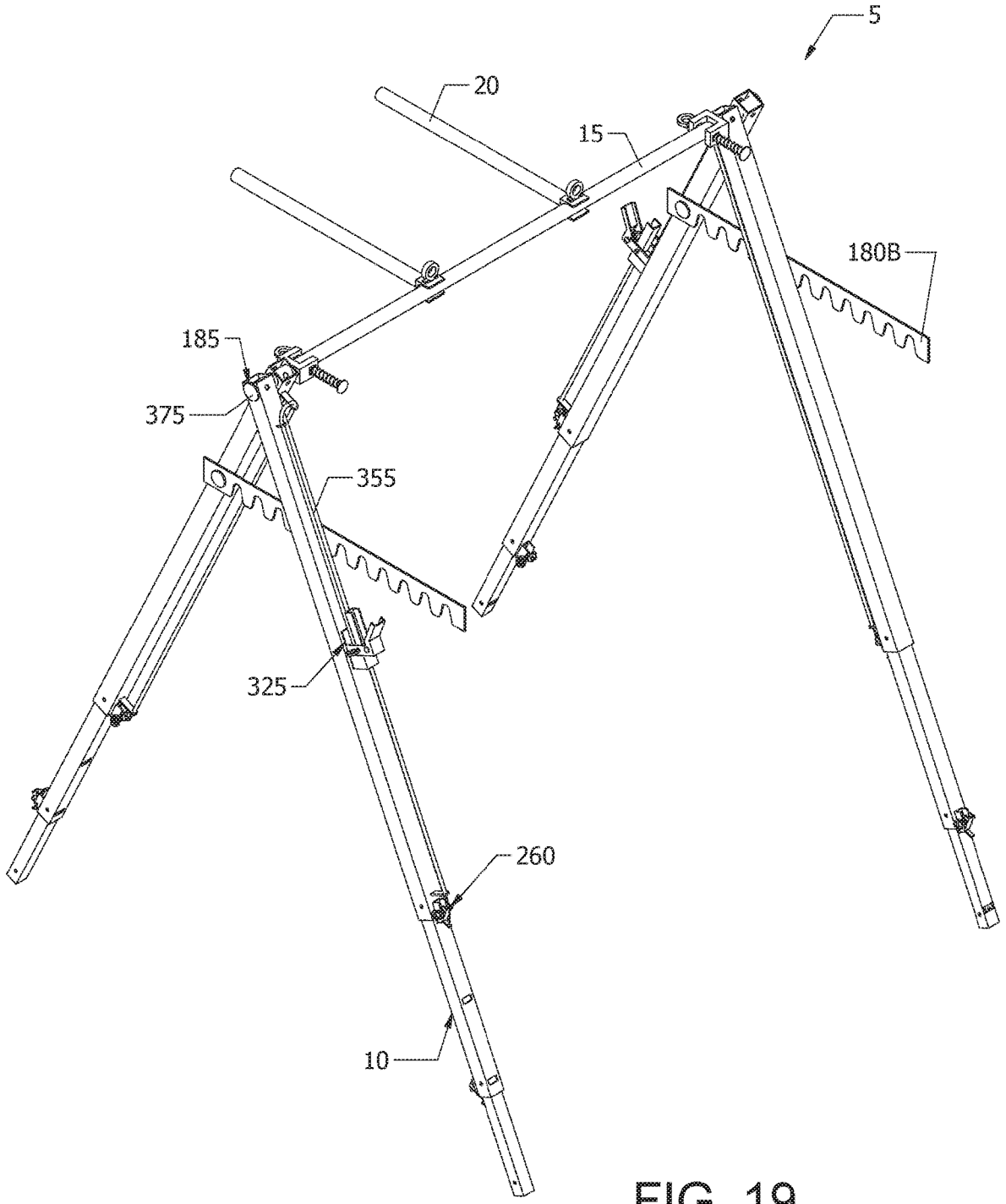
FIG. 19 is a perspective view of a second embodiment of a workout apparatus.
Figure 20:
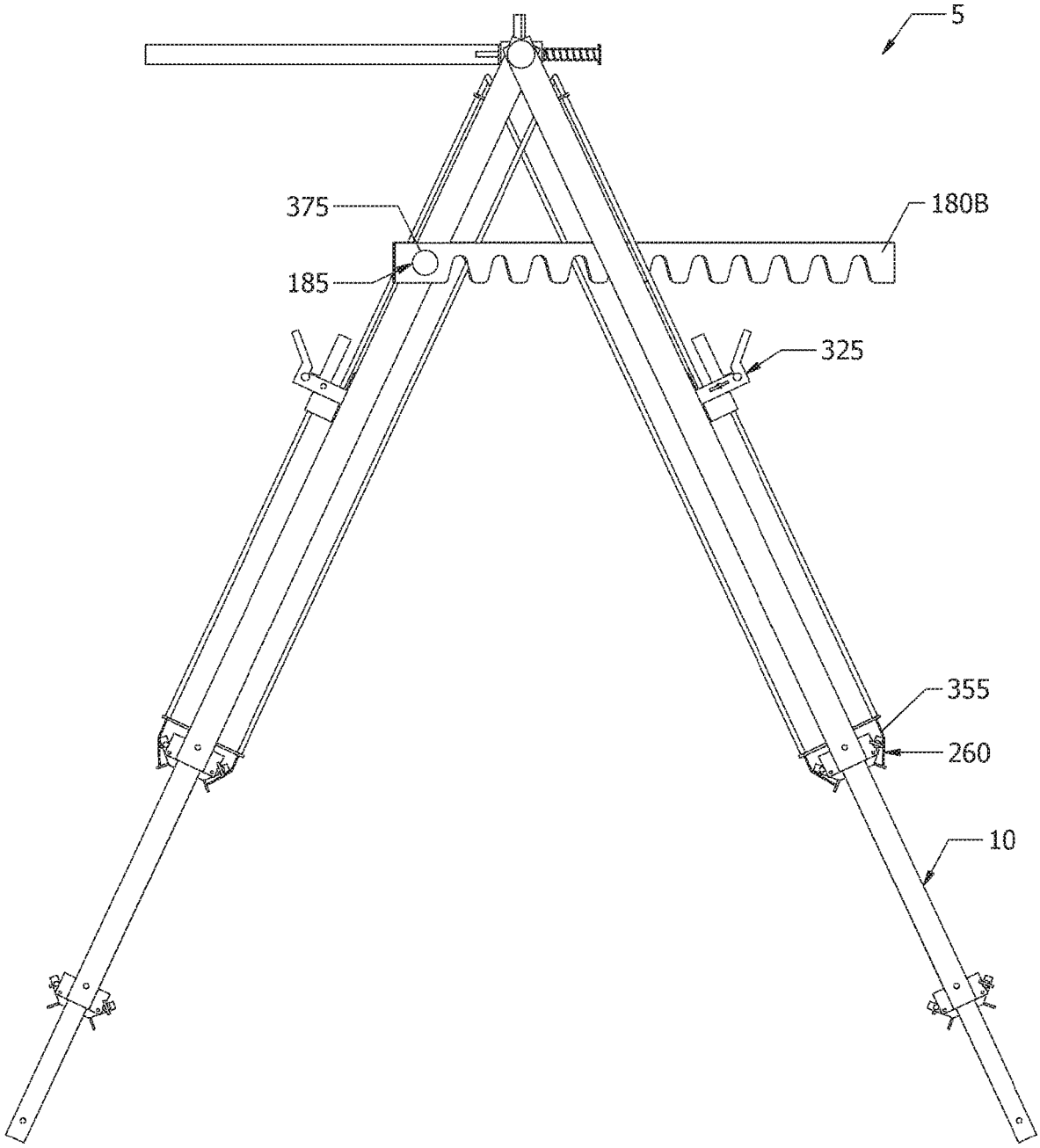
FIG. 20 is a side elevation view of the second embodiment of the workout apparatus of FIG. 19.
Figure 21:
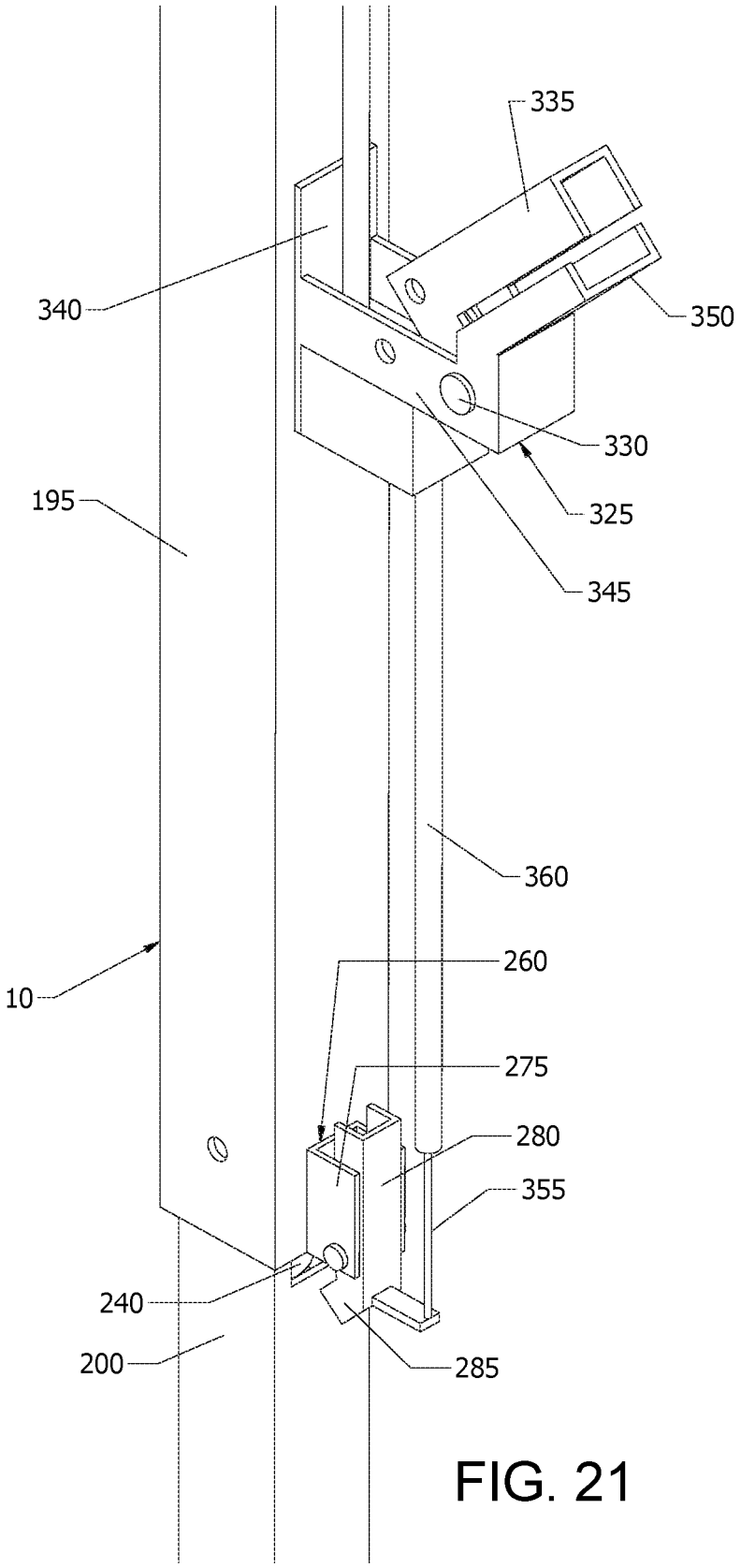
FIG. 21 is an enlarged perspective view of a spring telescoping leg with a hand actuated controller of FIGS. 19-20.

As seen in FIGS. 19-21, a third embodiment of the workout apparatus 5 may include telescoping legs 10 with a hand actuated controller 325 that allows a user to disengage multiple lock leg sections 285 from the telescoping leg apertures 240 at the same time. Alternatively, the hand actuated controller 325 can also disengage the lock leg sections 285 of the slide locking mechanism 260, from the telescoping leg apertures 240, of the pair of telescoping legs 10 at the same time. As best seen in FIG. 21, the hand actuated controller 325 may include a hand actuated pivot point 330, about which a hand actuated lever blade 335 can rotate. The hand actuated controller 325 further includes a hand actuated base section 340, which is preferably a substantially planar section, but may be any shape that that can be used to attach the hand actuated controller 325 to the telescoping leg 35 and/or 40. The hand actuated controller 325 also includes a hand actuated member 345 that is preferably an elongated member located and positioned perpendicularly adjacent to the hand actuated base section 340 so that the user is able to grasp the hand actuated lever blade 335. The hand actuated controller 325 also includes a hand actuated lever handle 350 located and positioned adjacent to the hand actuated member 345. The hand actuated lever handle 350 preferably is an elongated member shaped and angled so that the user may grasp the hand actuated lever handle 350 and the hand actuated lever blade 335 at the same time, and pull or squeeze the hand actuated lever blade 335 towards the hand actuated lever handle 350.

When the hand actuated lever blade 335 is pulled towards the hand actuated lever handle 350, the hand actuated lever blade 335 pulls on a cable 355 (in FIG. 20), which is connected to the lock leg section 285 of the slide locking mechanism 260. The cable 355 pulls the lock leg section 285 out of the telescoping leg aperture 240, thereby allowing the user to adjust the height of the telescoping legs 10. In some embodiments, the cable 355 may have a protective cable sleeve 360 surrounding at least a portion of the cable 355 thereby preventing the cable 355 from being damaged. The cable sleeve 360 is preferably be made out of plastic, although it may be made out of different materials such as metal. When cable 355 is pulled through the movement of the hand actuated lever blade 335, the cable 355 may be connected to at least one pulley 365 which allows the cable 355 to disengage the lock leg sections 285 from the telescoping leg apertures 240 of the telescoping legs 10. In an alternative embodiment, the hand actuated controller 325 can disengage all the slide locking mechanisms 260 located on at least one of the telescoping legs 10. In other embodiments, the hand actuated controller 325 may disengage all the slide locking mechanisms on all of the telescoping legs 35 and 40 of the workout apparatus 5 when the cable 355 is connected to all the hand actuated controllers 325 of the workout apparatus 5.

Figure 23:
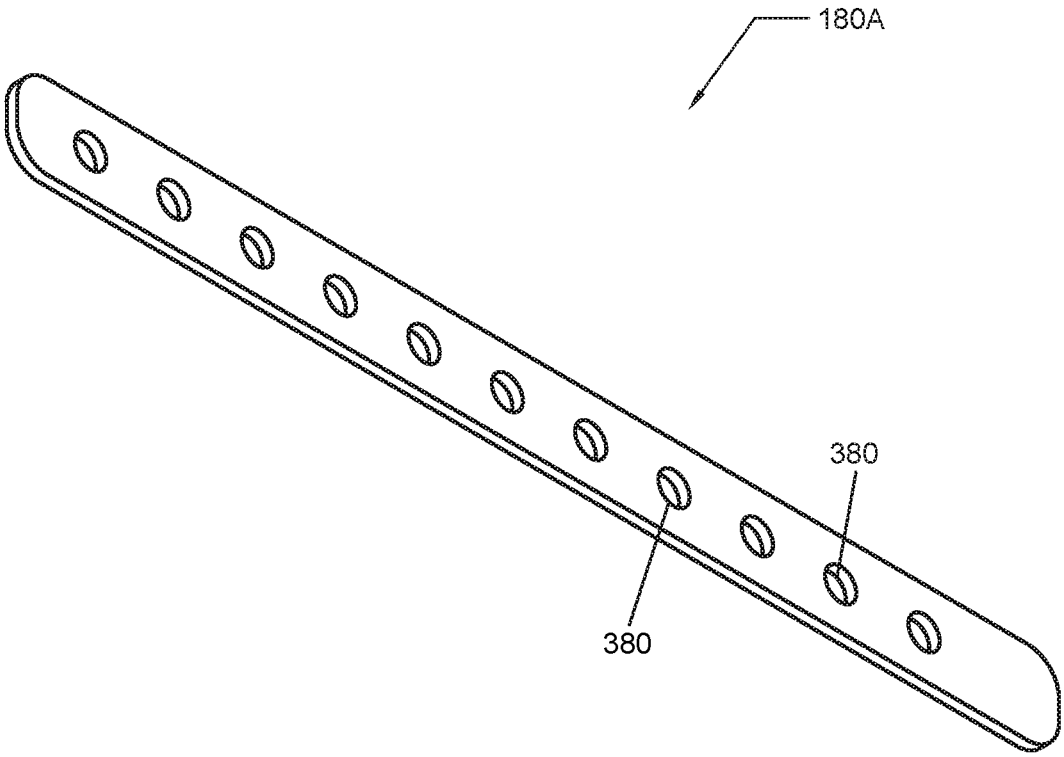
FIG. 23 is a perspective view of a first embodiment of a rigid link.

As seen in FIGS. 1-2, 19-20, and 23-24, the workout apparatus 5 may further include a rigid link 180A to stabilize the workout apparatus 5 and prevent the telescoping legs 10 from extending too far from one another and creating too great of an obtuse angle, thereby collapsing the workout apparatus 5. In one embodiment, the workout apparatus 5 preferably includes at least one rigid link attachment protrusion 185 on each telescoping leg 35 or 40. The rigid link attachment protrusion 185 preferably includes a cylindrical shank 370 with a rigid link head 375, having a larger diameter than the diameter of the cylindrical shank 370 of the rigid link attachment protrusion 185. In one embodiment, the rigid link 180A may be a planar elongated member with a series of circular rigid link apertures 380, as seen in FIG. 23.

The rigid link 180A may be placed on the telescoping legs 10 so that the at least one rigid link attachment protrusion 185 on each telescoping leg 35 or 40 is inserted into and extends through the rigid link apertures 380. The telescoping legs 10 and rigid link 180A thereby create an A-shape for increased stability and also prevent the telescoping legs 10 from having a too great of an obtuse angle or an acute angle, causing the workout apparatus 5 to fall. The rigid link aperture 380 and shape of the rigid link 180A may also combine to ensure that the rigid link 180A is not accidently knocked off of the rigid link attachment protrusion 185 due to the rigid link head 375 having a larger diameter than the cylindrical shank 370 of the rigid link attachment protrusion 185. The rigid link 180A would therefore have to be lifted off the rigid link attachment protrusion 185 because the greater diameter of rigid link head 375 would prevent the rigid link 180A from sliding off the rigid link attachment protrusion 185.

Figure 24:
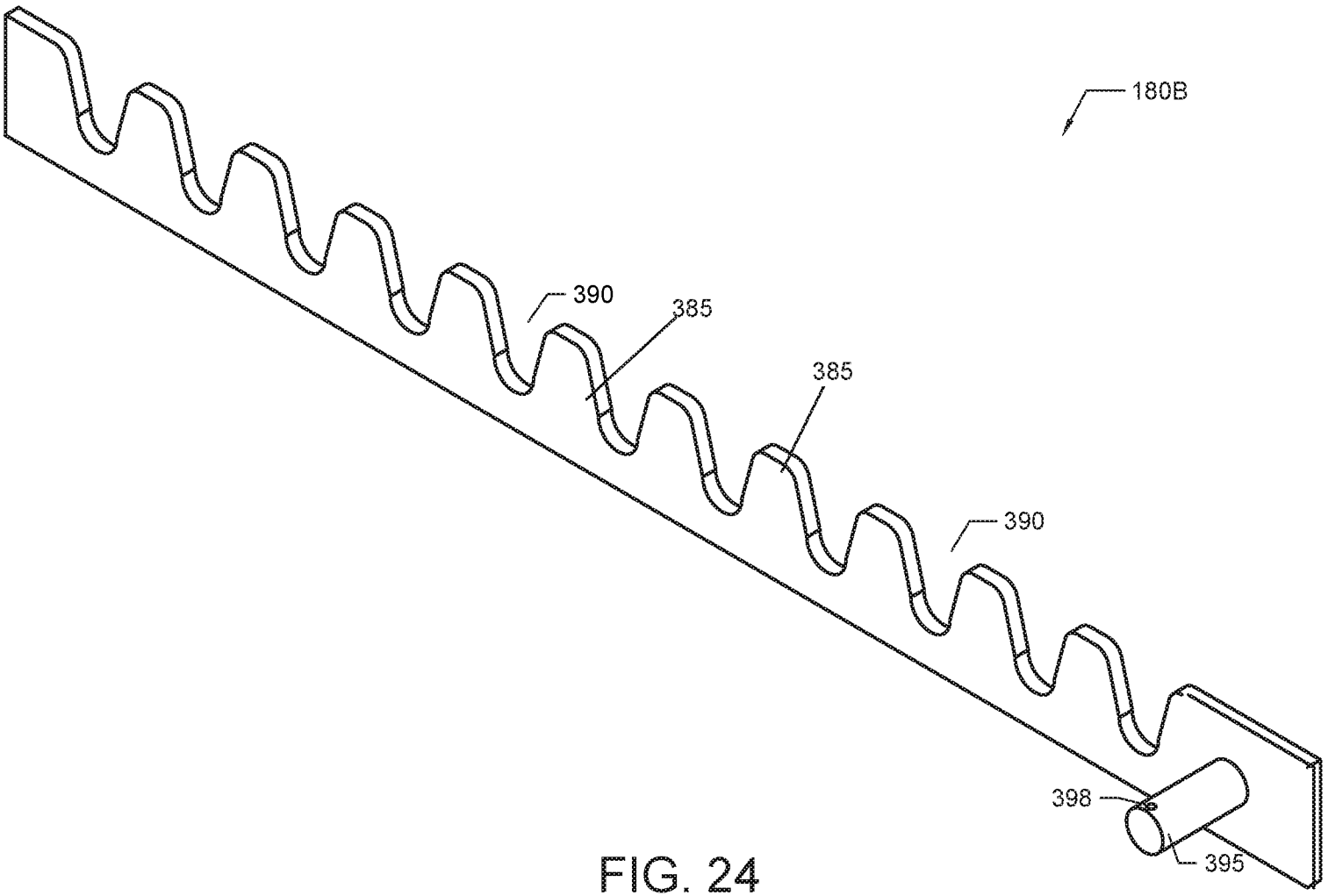
FIG. 24 is a perspective view of a second embodiment of the rigid link of FIGS. 1 and 19-20.

In an alternative embodiment shown in FIG. 24, the rigid link 180B may be a planar elongated comb-like member instead. The rigid link 180B may have a series of wave-like projections 385 and a series of wave-like indentions 390, which may be placed over the rigid link attachment protrusion 185 of the telescoping legs 10 to create an A-like shape, thereby increasing stability and preventing the workout apparatus 5 from collapsing under the weight of the user or dumbbells/weights. The rigid link 180B may further include a rigid link protrusion 395, which is preferably an elongated cylindrical member. The rigid link protrusion 395 may be inserted into and through one of the rigid link apertures 380, and secured using the safety pin 295 by inserting safety pin 295 through rigid link safety pin aperture 398 after the rigid link protrusion 395 has been inserted through the rigid link aperture 380. The rigid link 180B can therefore rotate around the rigid link aperture 260 and one of the wave-like indentions 390 may be placed on the rigid link attachment protrusion 185 to secure the telescoping legs 10 in place. In other embodiments, the length of the rigid link 180A or 180B may also be extendable or include ratcheting mechanisms, and therefore adjustable so that the rigid link 180A or 180B may achieve a variety of angles between the legs.

Figure 25:
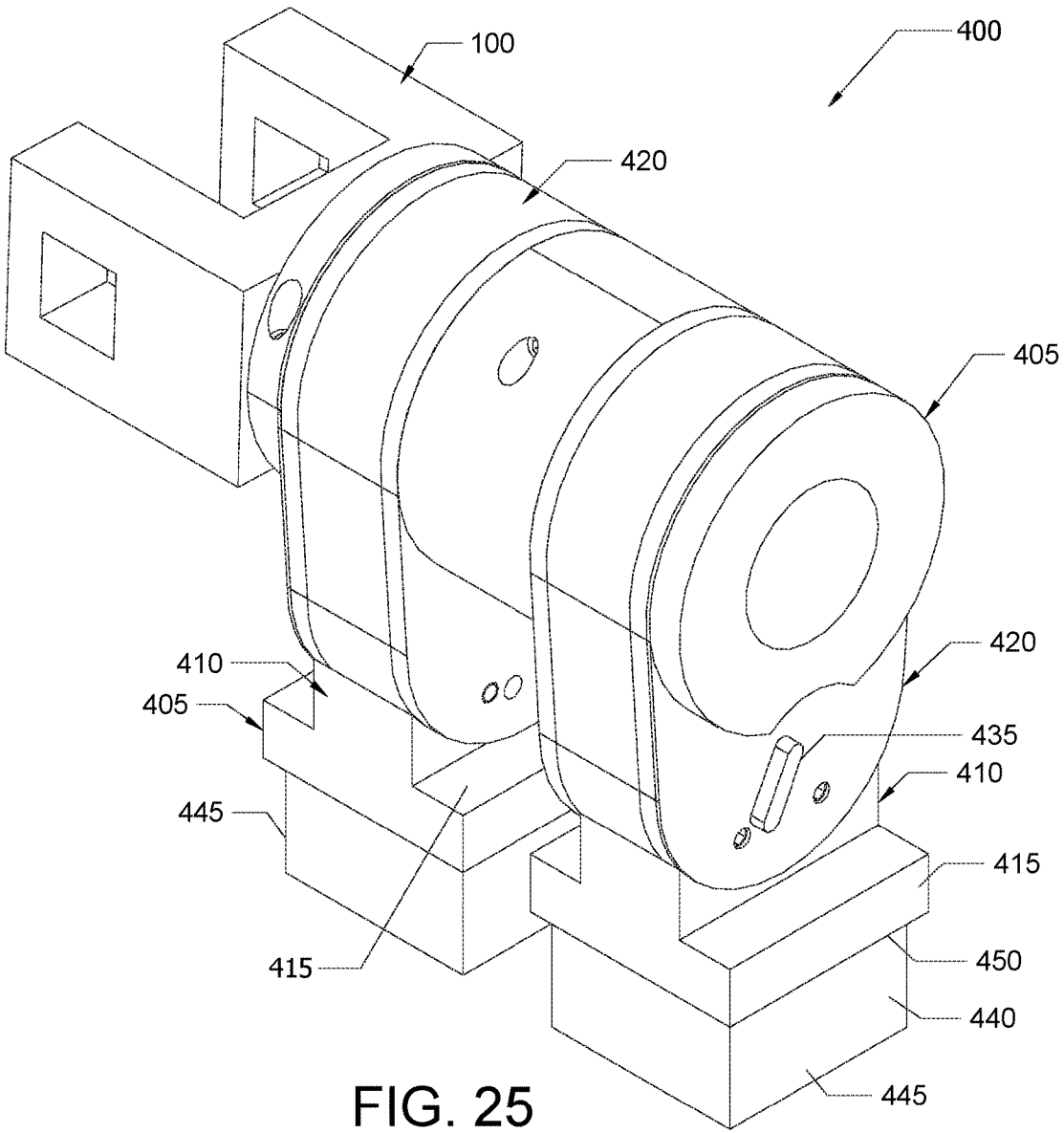
FIG. 25 is a perspective view of a ratcheting leg mechanism.
Figure 26:
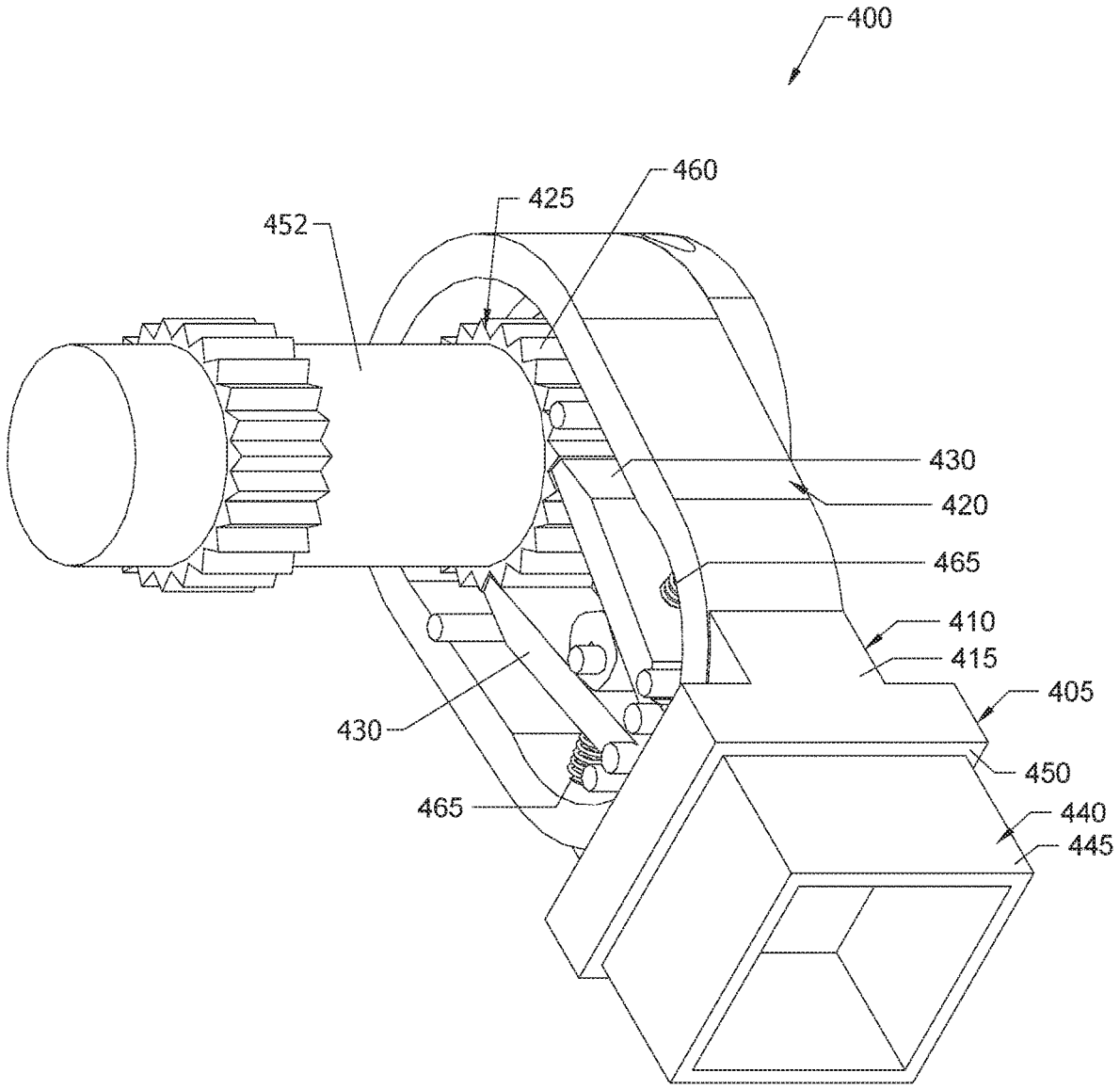
FIG. 26 is a perspective view of the opened ratcheting leg mechanism and locked pawl of FIG. 25.
Figure 27:
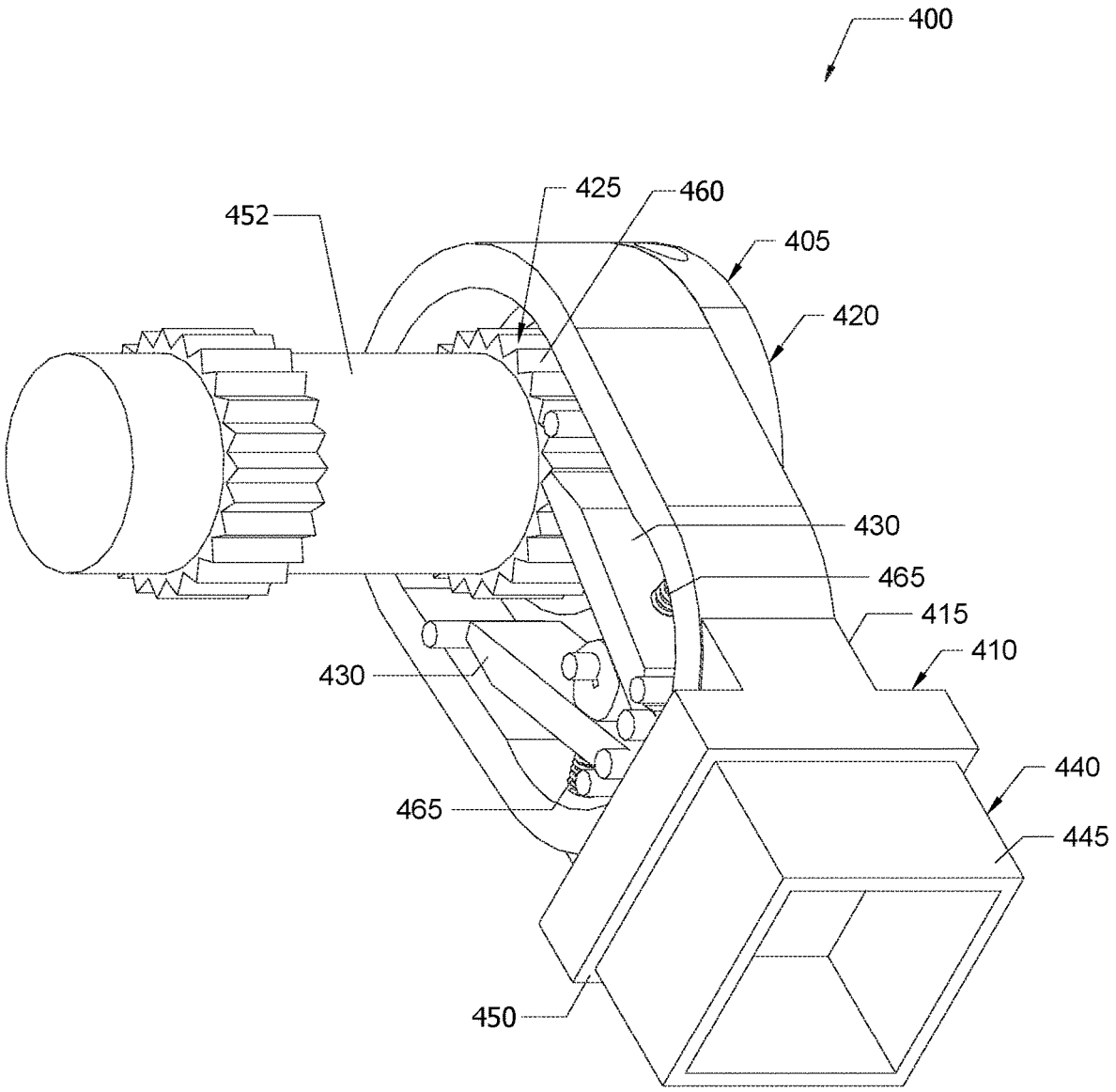
FIG. 27 is a perspective view of the opened ratcheting leg mechanism and unlocked pawl of FIGS. 25 and 26.

In another embodiment, the workout apparatus 5 may further include a ratcheting leg mechanism 400. As seen in FIGS. 25-27, the ratcheting leg mechanism 400 includes a ratcheting leg cap 405, which is adjacent and attached to both the inner and outer telescoping legs 35 and 40. The ratcheting leg cap 405 preferably includes a crossbar attachment section 410 that is preferably a rectangular section 415 and extends upwards into a housing 420 that contains a racket gear 425, a pawl 430, and a pawl lock 435 (all discussed in greater detail hereinafter). The ratcheting leg cap 405 also includes a telescoping leg attachment section 440, located and positioned below the crossbar attachment section 410, and is preferably shaped and sized to fit into the telescoping legs 35 and 40. The telescoping leg attachment section 440 is inserted into the upper end 75 of the telescoping leg 35 and/or 40 so that the outer surface 445 of the telescoping leg attachment section abuts the inner surface of the telescoping leg 35 and (not shown). The lower rim 450 of the crossbar attachment section 410 abuts and rests on the upper rim (not shown) of the telescoping leg 35 and 40. The housing 420 further contains the pivot mount member 452 that extends through the housing 420, where the pivot mount member 425 is preferably an elongated cylindrical member that engages the U-shaped component 100. Thus, the combination of the pivot mount member 425 and the U-shaped component 100 is substantially similar to pivot mount 25. The telescoping legs 10 may therefore be attached to the crossbar 15, in conjunction with the U-shaped component 100 and adjuster pin 30, as seen in the previous workout apparatus embodiments discussed previously.

The housing 420 contains the racket gear 425 which, in conjunction with the pawl 430 and pawl lock 435, prevents the telescoping legs 10 from moving into either a further acute or obtuse angle. The racket gear 425 is preferably an annular ring containing a series of grooves 460 on the outer surface of the annular ring. The pawl 430 is preferably a member of any size and shape, as long as it can it fit into a groove 460 and can prevent the racket gear 425 from moving when it is in a locked position and also allow the racket gear 425 to turn when the pawl 430 is in an unlocked position. The housing 420 further contains a spring 465, connected and pushes the pawl 430 into the grooves 460 of the racket gear 425. The pawl lock 435 may be used to lock the pawl 430 into place and prevent the racket gear 425 from turning. In some embodiments, the housing 420 may contain multiple pawls 420 and pawl locks 435 which may each independently lock racket gear 425 into place. In another embodiment, a single pawl 420 may prevent the racket gear 425 from rotating clockwise, while another single pawl 420 may prevent the racket gear from rotating counterclockwise, and only the combination of both pawls 420 prevents rotation in either direction, and therefore prevents the angle of telescoping legs 10 from being adjusted.

Figure 28:
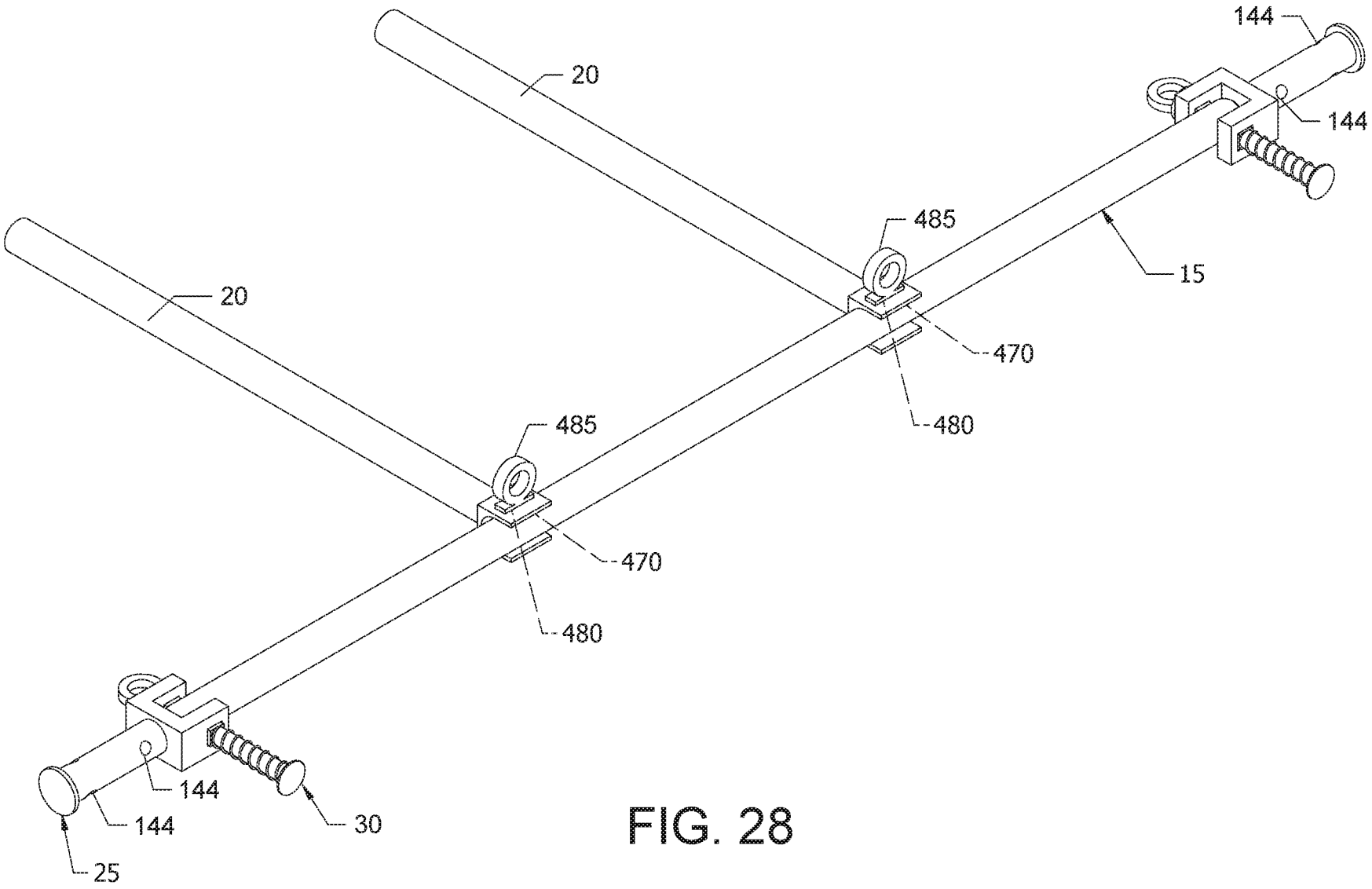
FIG. 28 is a perspective view at least one dip bar attached to a crossbar of FIGS. 1, 19, and 20.

Turning to FIG. 28, the workout apparatus 5 further includes the crossbar 15, which is preferably an elongated cylindrical member. The crossbar 15 is adjacent and abuts both pairs of telescoping legs 10, and connects both pairs of telescoping legs 10. The crossbar 15 includes at least one crossbar dip bar aperture 470 that is used to attach at least one dip bars 20 to the crossbar 15. The dip bars 20 may each be an elongated cylinder with a dip bar attachment projection 475, which may be two substantially parallel sheets, sized and shaped to mate with the crossbar 15 where the crossbar 15 may be placed in-between the dip bar attachment projection 475. The dip bar attachment projection 475 each include at least one dip bar aperture 480 that aligns with the crossbar dip bar apertures 470 so that at least one bolt 485 may be used to connect the dip bars 20 to the crossbar 15. In some embodiments, bolts 485 may be welded or glued into place. However, in the preferred embodiment, at least one bolt 485 may be held in place, and thus also holding dip bars 20 in place, through gravity. The bolts 485 may be further secured through at least one safety pin 295. Therefore, dip bars 20 may be removed from the workout apparatus 5 if the workout apparatus 5 is to be moved or stored. Other methods of connecting the dip bars 20 to the crossbar 15 are envisioned and foreseen. The dip bars 20 may further include a grip handle or a textured area to allow for an improved grip located and positioned on the opposite end 490 from the dip bar projection 290.

In one embodiment, the dip bars 20 are attached to the crossbar 15 and further secured by dip bar stabilization pins 495, where the dip bar stabilization pins 495 are inserted into the dip bar stabilization aperture 144 are located and positioned in the pivot mount cylindrical member 95. The dip bar stabilization aperture 144 and dip bar stabilization pins 495 prevent the dip bars 20 and the crossbar 15 from spinning in place when torsional force is applied (e.g. when a user attempts to do a dip on the dip bars). The dip bar stabilization pins 495 may also further stabilize the telescoping legs 10 when they are inserted into either one of the dip bar stabilization aperture 144, thereby retaining the angle of the telescoping legs—preferably either at a 35 degree angle or 45 degree angle, as seen in FIGS. 3 and 28.

Figure 29:
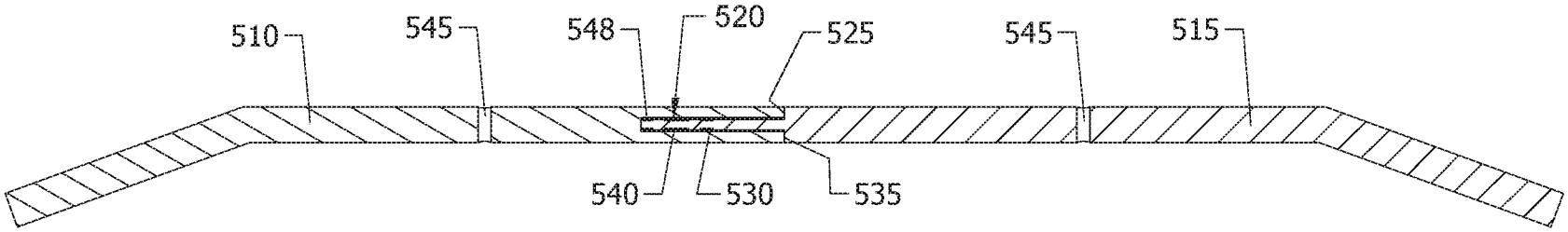
FIG. 29 is a perspective view of an attachable pullup bar connected to the dip bars of FIGS. 1, 19-20, and 28.

In further embodiments, the dip bars 20 may further serve as a support for a pullup bar 505. As shown in FIG. 29, the pullup bar 505 may include two cylindrical elongated members: a first pullup bar member 510 and a second pullup bar member 515. The first pullup bar member 510 has an annular ring or knob 520 located and positioned at a first circular end 525. The annular ring 520 includes a first set of threads 528, which extends radially outward from an outer surface of the annular ring 520. The pullup bar 505 may further include a second pullup bar member 515, which includes a pullup bar aperture 530 located and positioned at a second circular end 535 of the second pullup bar member 515, adjacent and abutting the annular ring 520 of the first pullup bar member 510 when the first pullup bar member 510 and the second pullup bar member 515 are selectively engaged, which will be explained in more detail hereinafter. The pullup bar aperture 530 includes a second set of threads 540 extending inwardly from the surface of the pullup bar aperture 530. The first set of threads 530 and the second set of threads 540 are used to selectively engage the first pullup bar member 510 and the second pullup bar member 515 with one another through a threaded engagement known and understood in the art. In alternative embodiments, the first pullup bar member 510 and second pullup bar member 515 may selectively engage each other through a friction fit, or any other method known in the art. The first pullup bar member 510 and the second pullup bar member 515 allows the pullup bar 505 to have a length greater than the crossbar 15, and also allows the pullup bar 505 to be easily moved and stored in a smaller area due to its reduced size.

Figure 30:
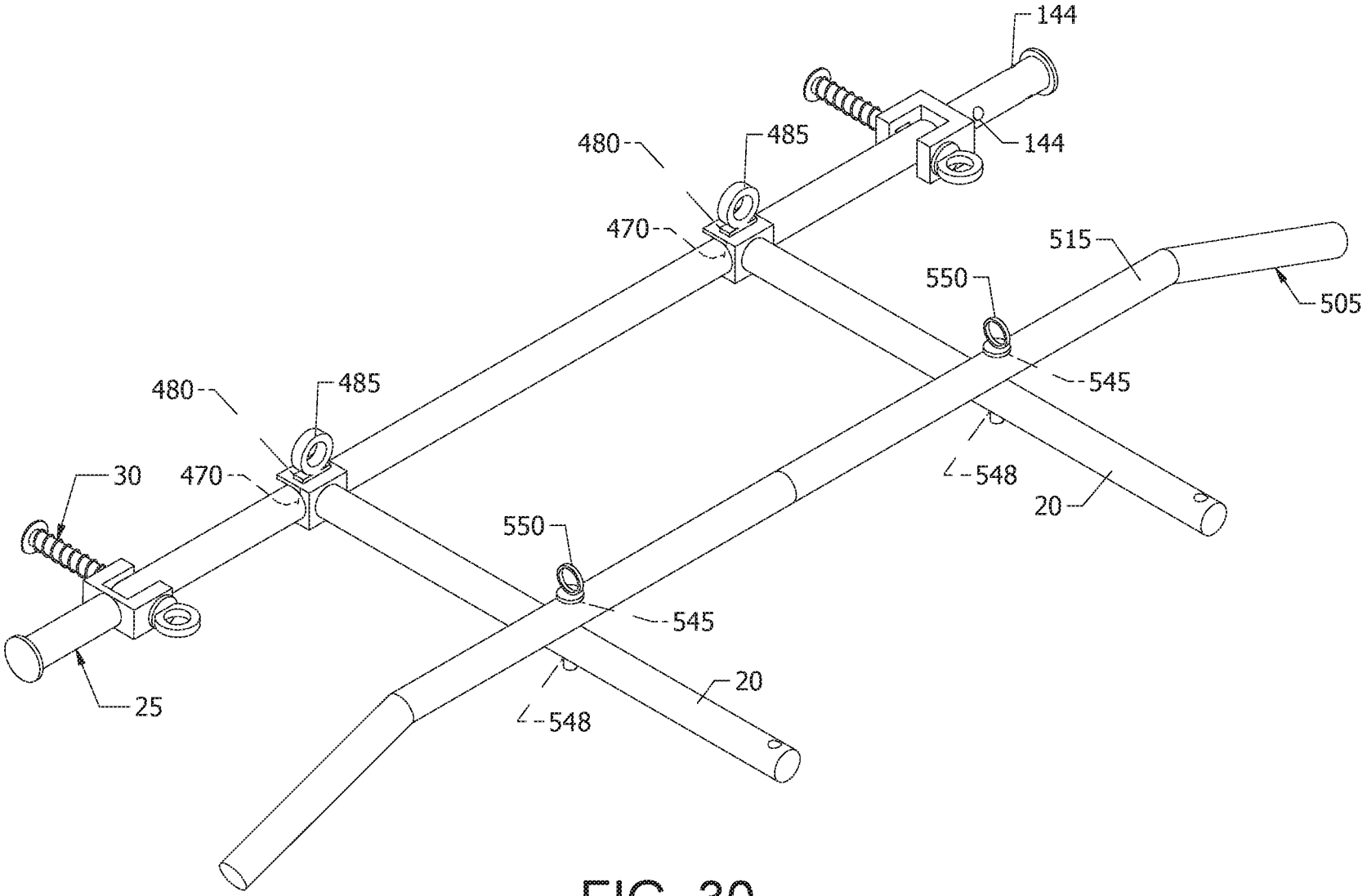
FIG. 30 is a cross section view of the pullup bar of FIG. 29.

The pullup bar 505 may further include at least two pullup attachment apertures 545, which allow the pullup bar 505 to be attached to the dip bars 20, as illustrated in FIG. 30. The pullup attachment apertures 545 extend through the pullup bar 505 and align with at least two dip bar pullup attachment apertures 548, which extend through the dip bars 20. A pullup bar adjuster pin 550, substantially similar to safety pin 295, may be used to selectively engage pullup bar 505 to dip bars 20, and therefore, the workout apparatus 5.

As seen in FIG. 1, in yet another alternative embodiment of the invention, the telescoping legs 10 may include an adjustable barbell rack 555 made from at least two mounts 560. Mounts 560 are each attached to a telescoping leg, positioned on either the distal side 140 of the outer telescoping leg and/or the proximal side 142 of the inner telescoping leg, each pair of mounts 560 parallel and opposite from one another at corresponding heights. The mounts 560 may include a base mount 565 preferably a substantially planar member having at least two protrusions 570 located perpendicularly from the base mount 565 which may be inserted into the circular apertures 265 of the telescoping legs 10 and secured using the safety pin 295. The protrusions 570 of the base mount 565 are spaced according to the spacing between the circular apertures 265 of the telescoping legs 10, and therefore may be positioned at any height the user desires. The mounts 560 further includes a mount member 575, an elongated member adjacent and attached to the base mount 656, and substantially parallel to the floor when the mount 560 is attached to the telescoping legs 10. The mount 560 further includes a mount lip 580, preferably adjacent and substantially perpendicular to the mount member 575, thereby preventing the barbell from falling off of the mount member 575. In a preferred embodiment, the base mount 565 and mount member 575 are preferably angled at 65 degrees away from one another so that the mount member 575 is parallel to the floor when the mount 560 is attached to the telescoping legs 10. The mount lip 580 is preferably at a 25 degree angle when compared to the vertical axis of the workout apparatus 5. However, the mount lip 580 may be at any angle, as long as the mount lip 580 prevents the weights from falling off of the mounts 560. Similarly, the mount 560 may also be at any angle, as long as the mounts 560 are able to hold and retain the weights.

Figure 31:
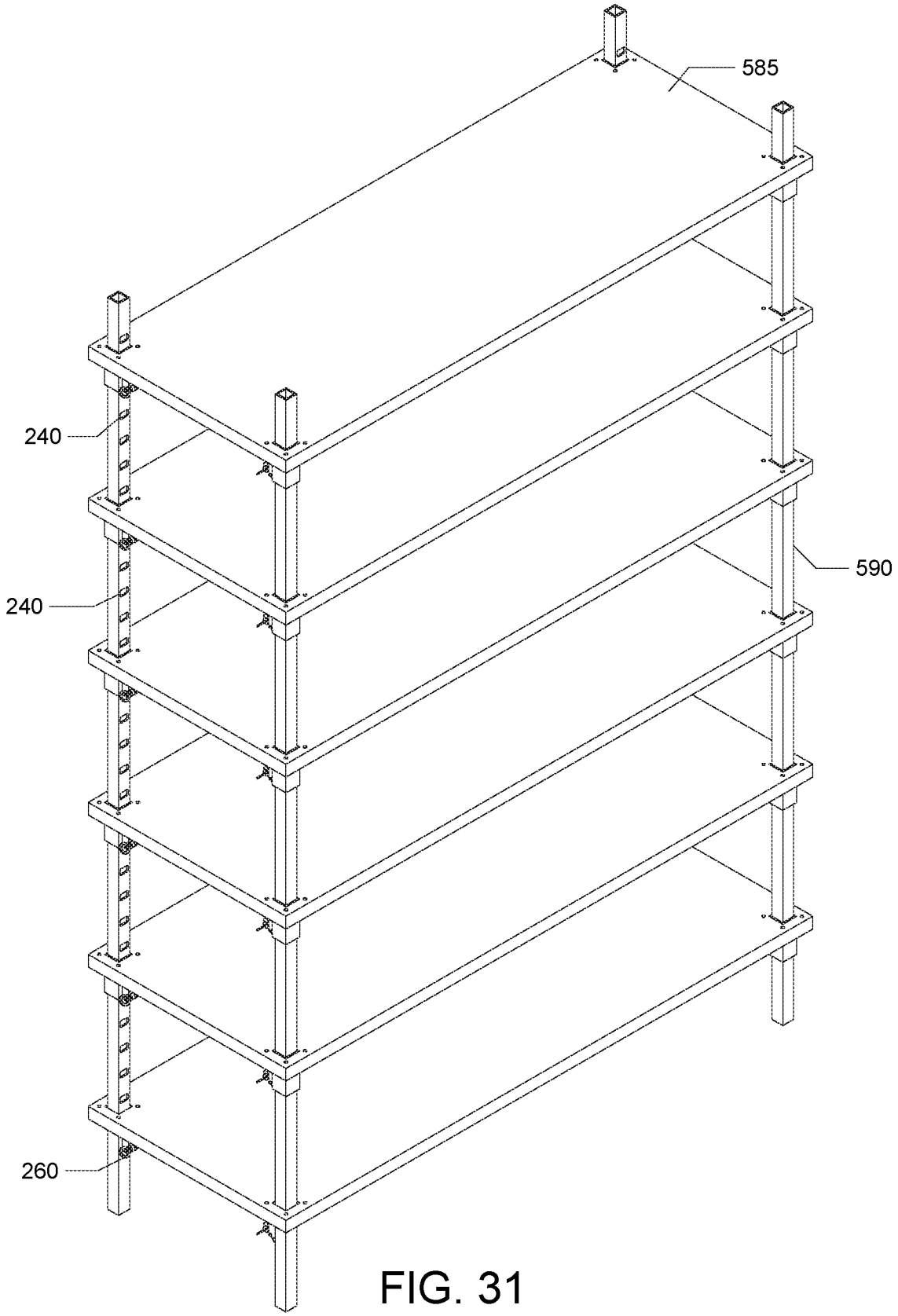
FIG. 31 is a perspective view of a height adjustable shelves.
Figure 32:
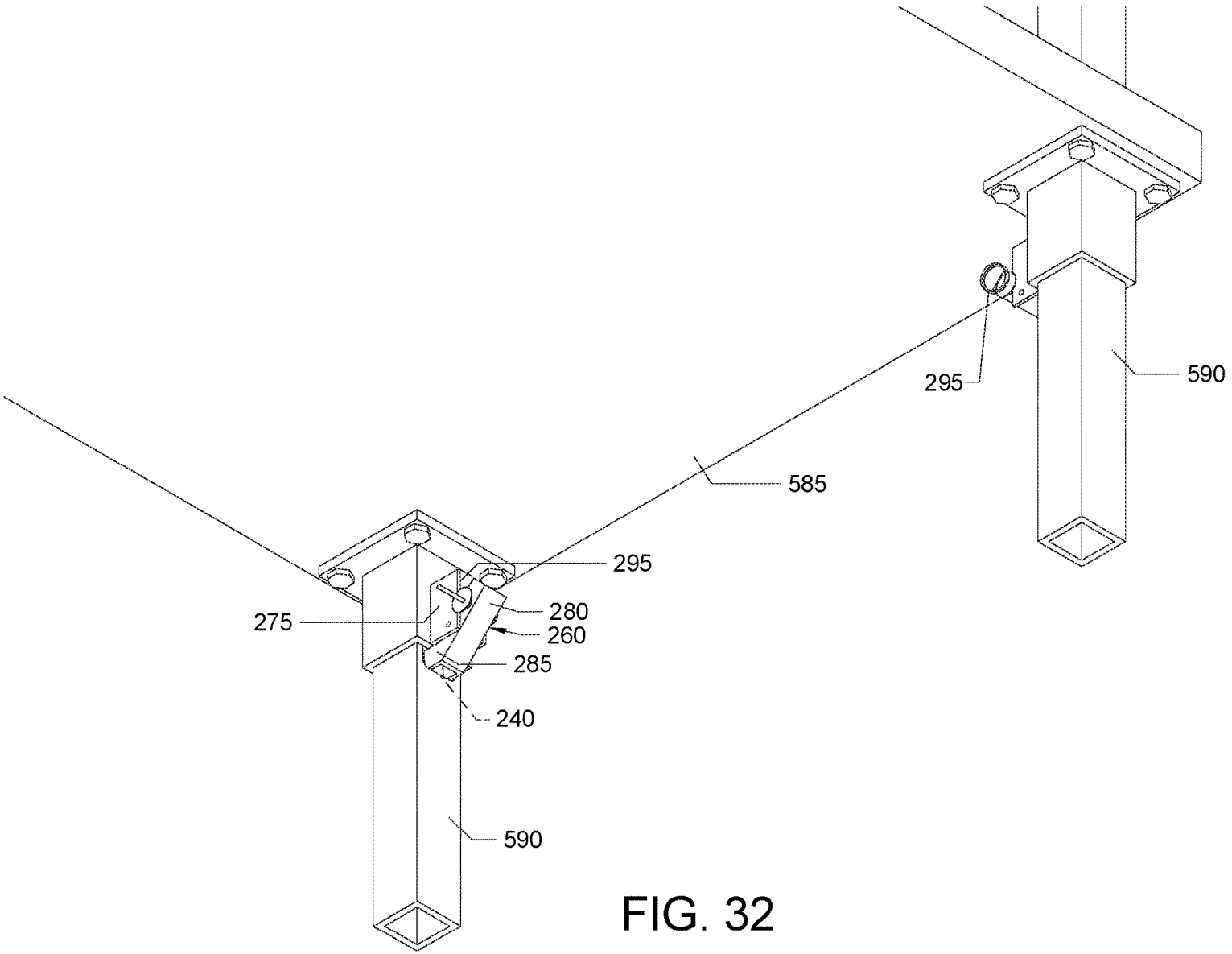
FIG. 32 is an enlarged bottom perspective view of the height adjustable shelves of FIG. 31.
Figure 33:
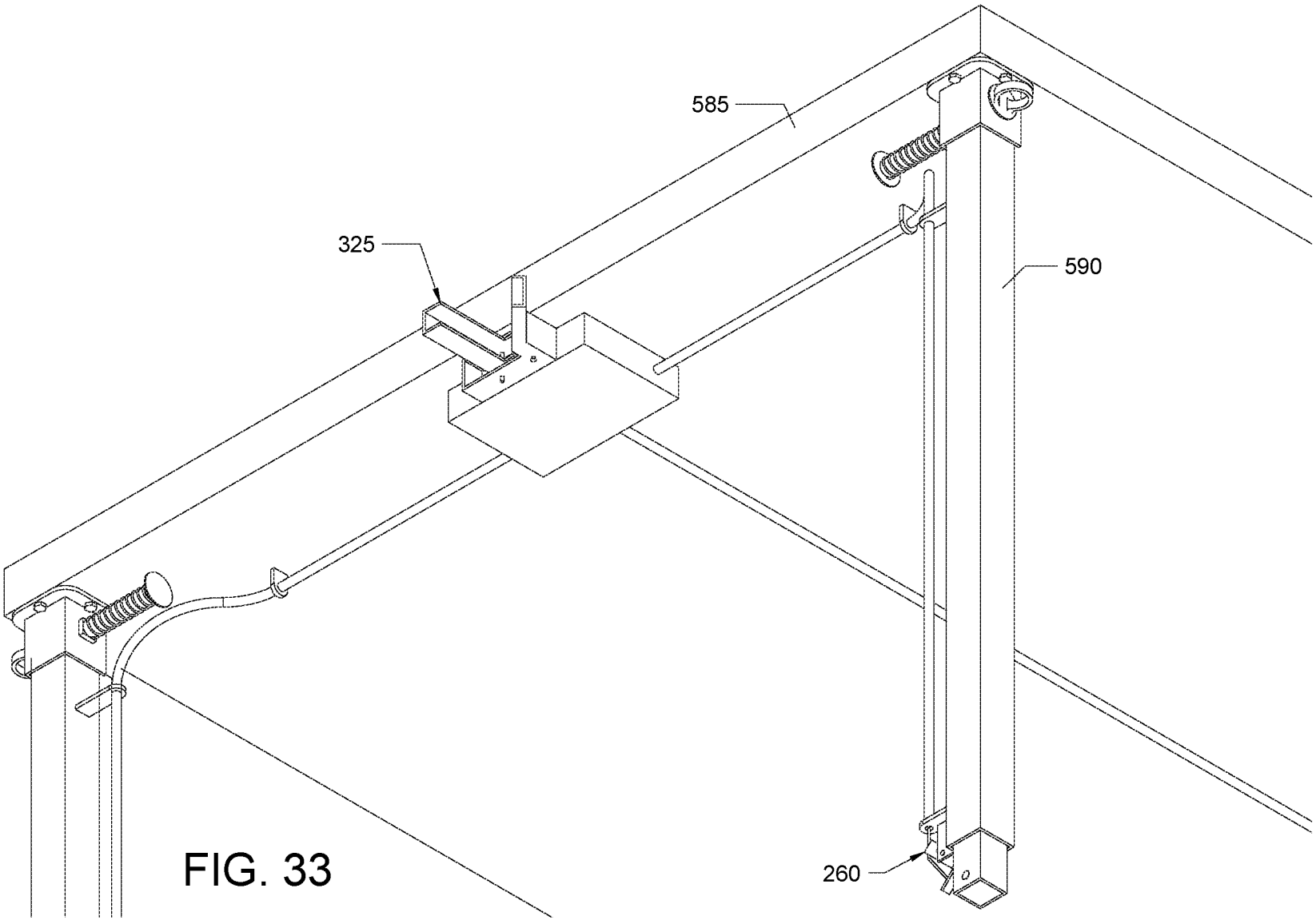
FIG. 33 is a bottom perspective view of a hand actuated height adjustable table.

The slide locking mechanism 260 or the hand actuated controller 325 may be also used in conjunction with a horizontal component. For example, the horizontal component may be furniture, there the height of the shelf or top of a table 585 may be adjusted. The shelf or tabletop 585 may further be adjusted without having to disassemble the table 585 or even clearing off the shelf 585. As seen in FIGS. 31-33, the at least two supports or legs 590 of a shelf or table 585 are substantially similar to a single leg section of the telescoping legs 35 or 40 of the workout apparatus 5. The legs 590, therefore, are preferably a single section (instead of the legs containing multiple sections—e.g., an outer section and an inner section) with locking apertures 240. Thus, as with the telescoping legs 10 of the workout apparatus 5, the user may use the slide locking mechanism 260, in the same way, to adjust the height of the top of the shelf or table 585. Similarly, as seen in FIG. 33, the user may also use a hand actuated controller 325 to adjust the height of the shelf or table 585. Additionally, while the user may adjust the height of the table 585 by hand, the user may also use a forklift to simultaneously raise the top of the table 585 or the shelf to prevent any items from sliding due to an angled surface.

Figure 34:
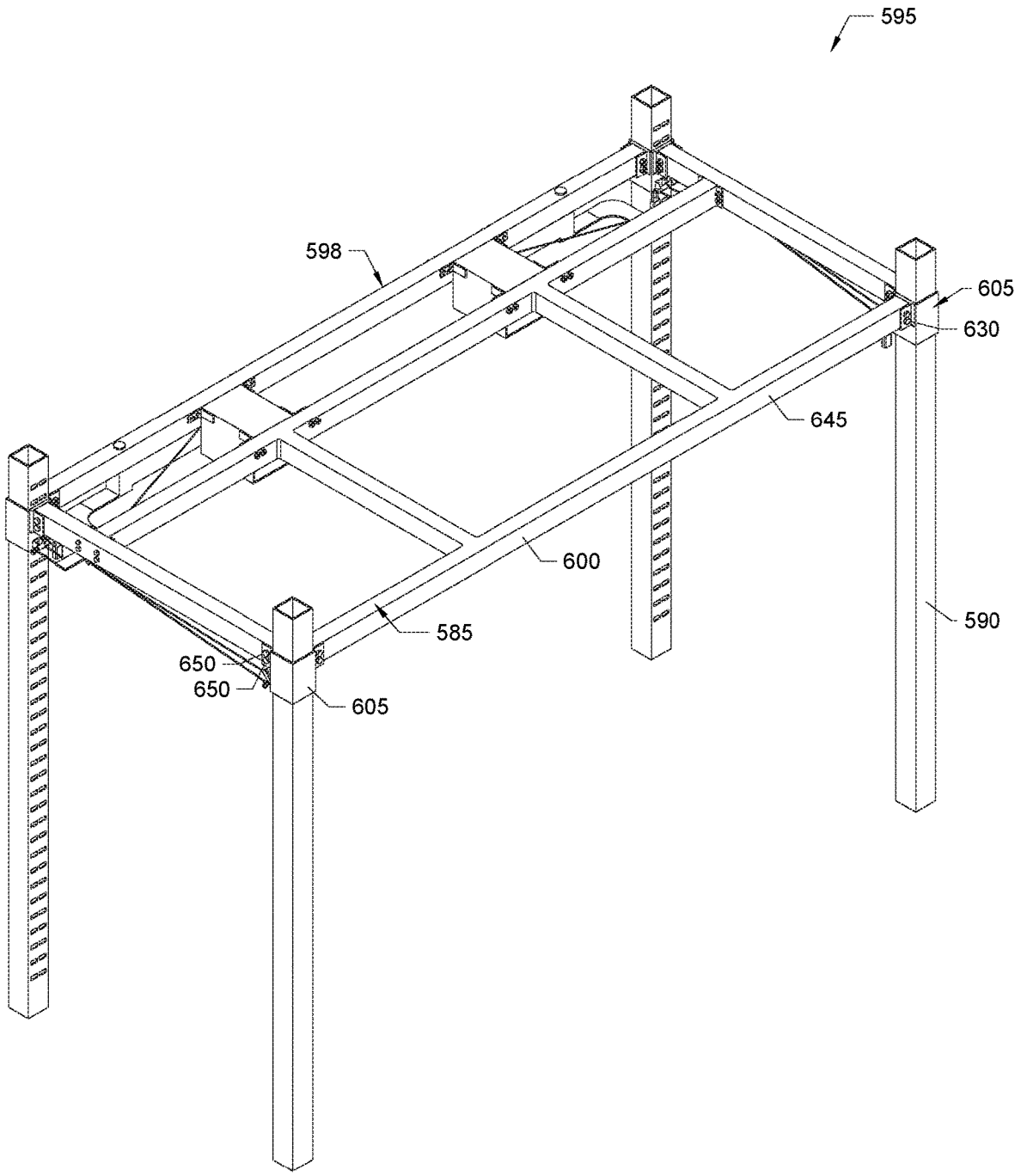
FIG. 34 is a top perspective view of a lever actuated height adjustable pallet rack.
Figure 35:
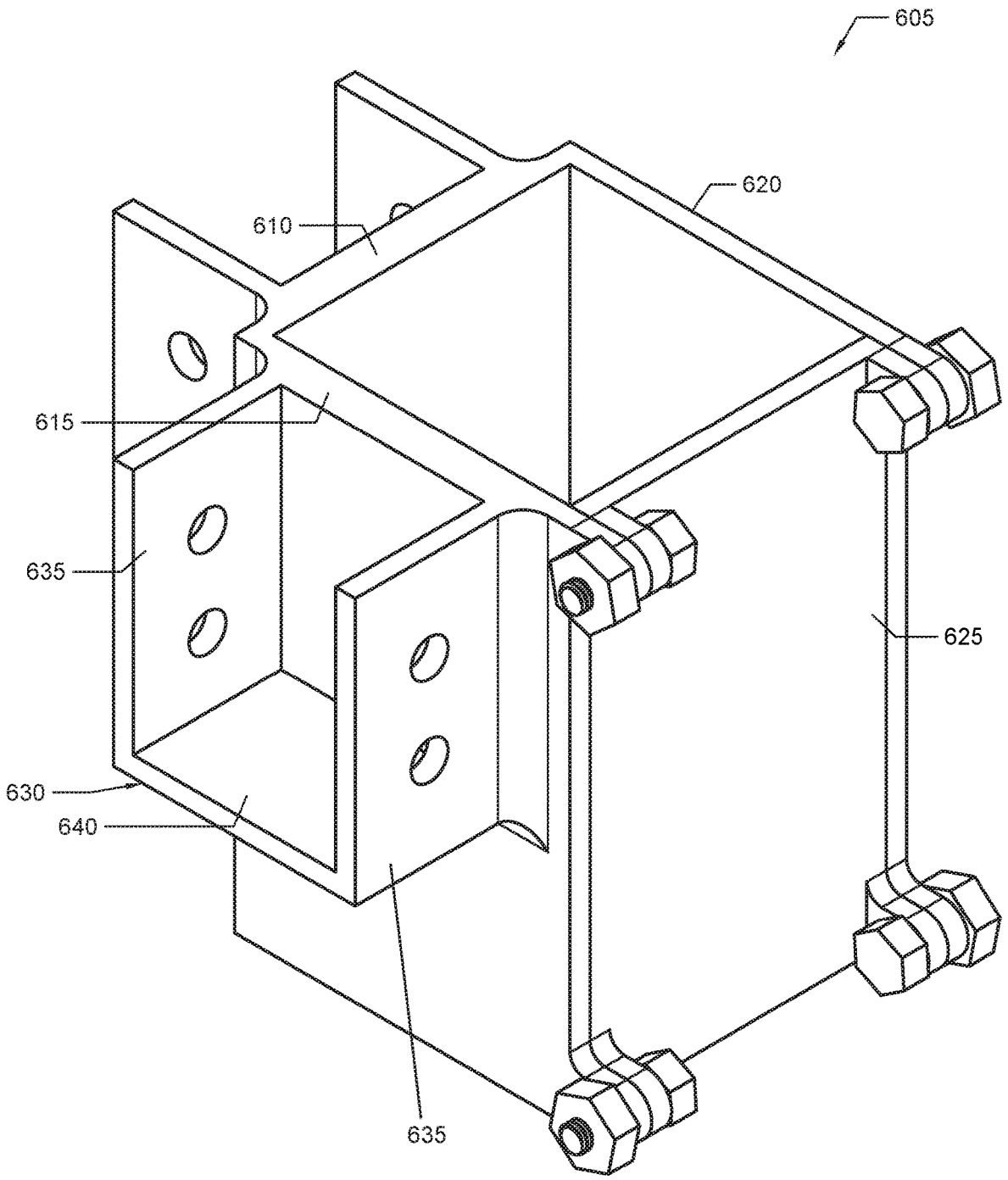
FIG. 35 is a perspective view of a removable shelf support.
Figure 36:
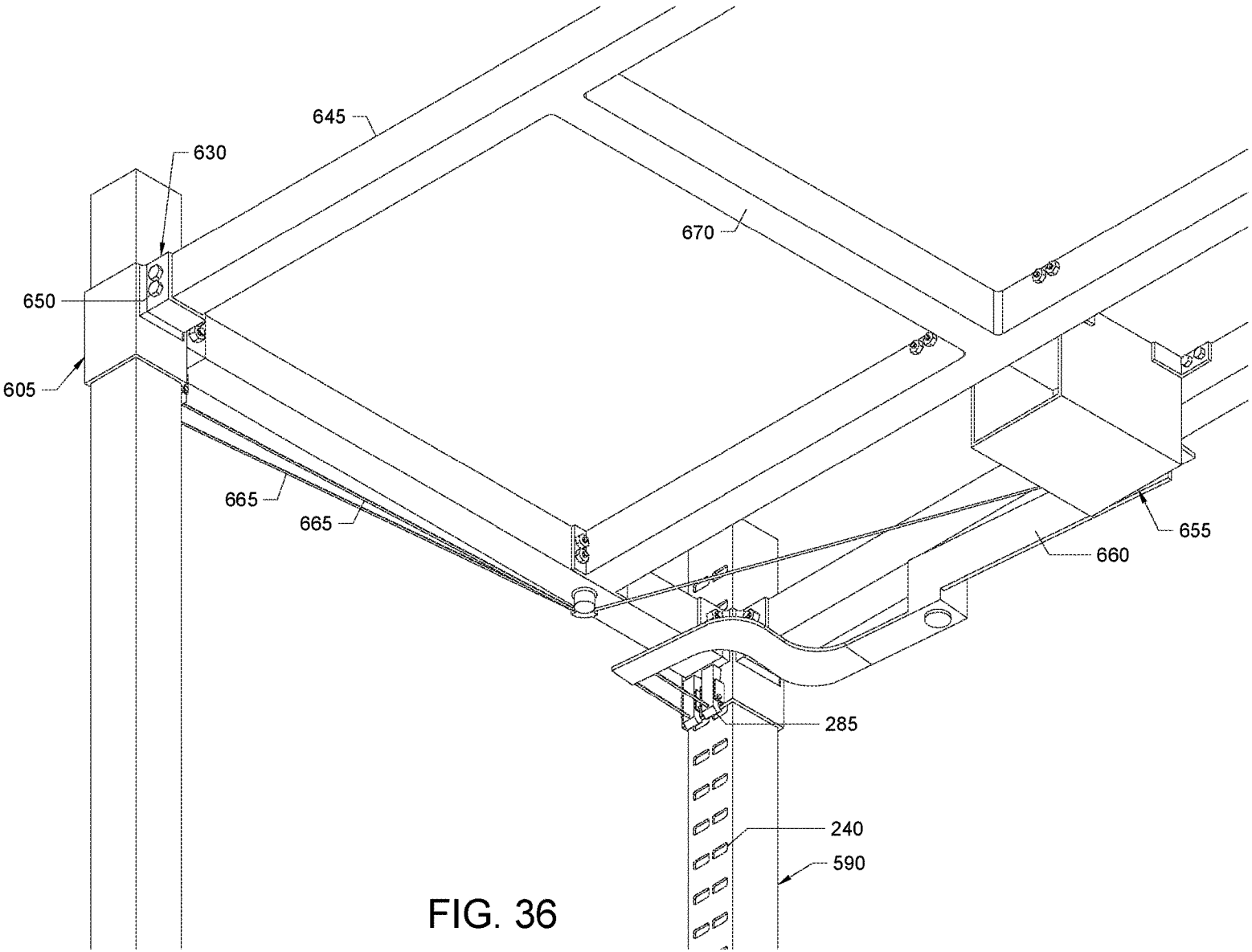
FIG. 36 is an enlarged bottom perspective view of the actuated height adjustable pallet rack of FIG. 34.

Illustrated in FIGS. 33-34, a spring box lever system 595 can also be used to adjust the height of furniture (e.g. a pallet rack) instead of the slide locking mechanism 260 or the hand controller 185. The pallet rack 598 includes the legs 590 and the table top or shelf 585. In a pallet rack 598, the table 585 may be or may include a shelf skirt 600 which can support a board (not shown) or other surface that is preferably substantially planar so that a user may place items on it. The shelf skirt 600 is attached the legs 590 of the pallet rack 598 through a shelf support 605, as shown in FIGS. 34-36. The shelf support 605 preferably includes four substantially planar sides, creating a rectangle surrounding each leg 590. The shelf support 605 includes a front side 610, a left side 615, and a right side 620, where the left side 615 and the right side 620 are opposite from one another. The left side 615 is also adjacent and attached to the front side 610, as is the right side 620. Thus, the left side 615, front side 610, and right side 620 are attached to one another to create a U-shape. The shelf support further includes a back side 625, opposite to the front side 610, which is selectively attachable to both the left side 615 and the right side 620 of the shelf support 605.

The front side 610 and the left side 615, of the shelf support 605, also include shelf brackets 630. Each shelf bracket 630 includes two side faces 635 and a bottom face 640, each located and positioned perpendicular to either the front side 610 or left side 615 of the shelf support 605 and creating a U-shape, so that a shelf shirt member 645 may be inserted within the shelf bracket 630 to create the shelf skirt 600. The shelf shirt member 645 may be secured to the shelf bracket 630 through at least one screw 650 or other methods known in the art. Thus, the removable back side 625 of the shelf support 605 allows the user to add the shelf support 605 to a leg 590 without having to remove the shelf 585 or shelf skirt 600, and add a shelf 585 anywhere on the set of shelves and not just from either the top or the bottom of the shelves.

Figure 37:
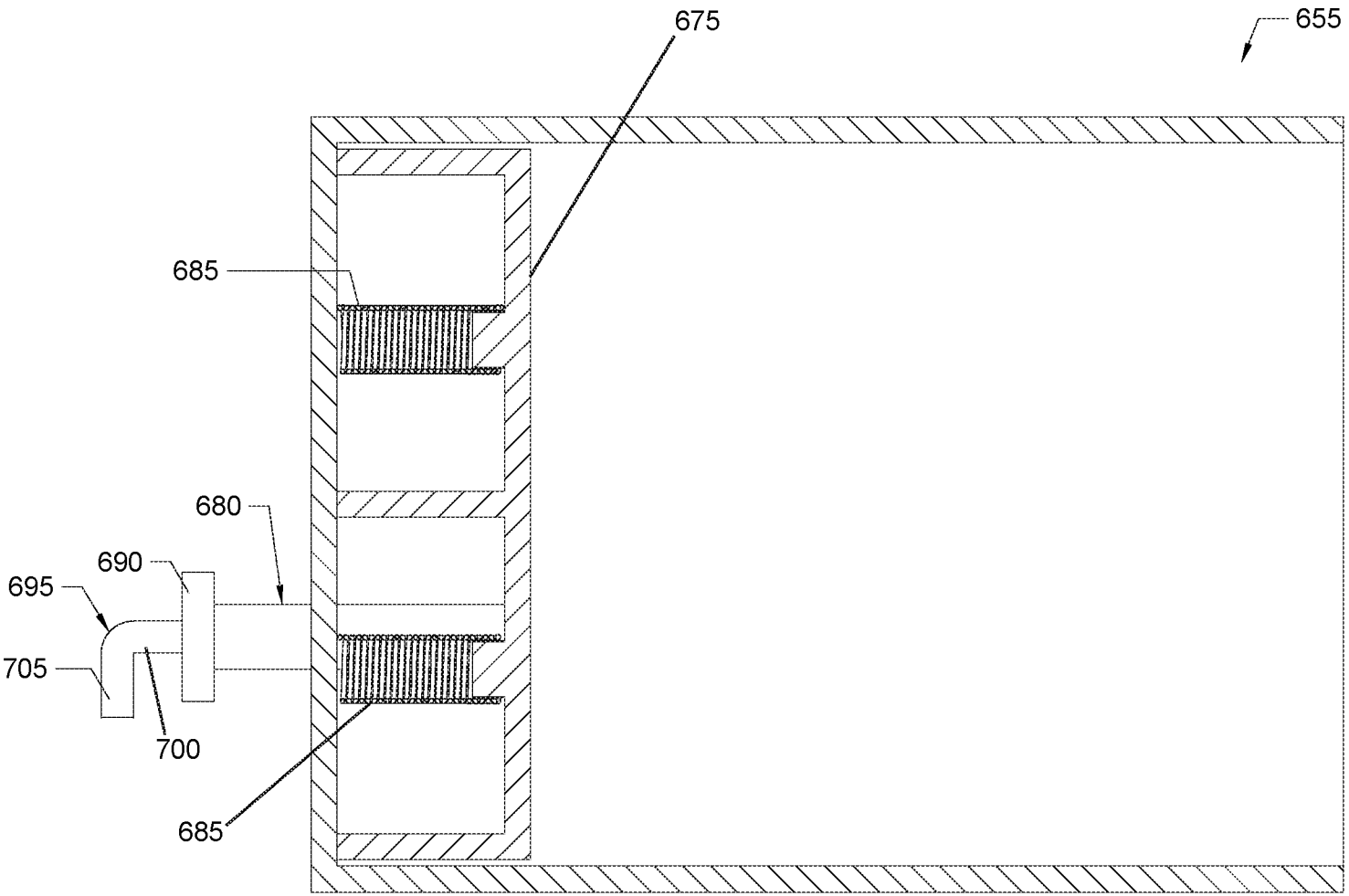
FIG. 37 is a cross section view of a spring housing box of FIGS. 34 and 36.
Figure 39:
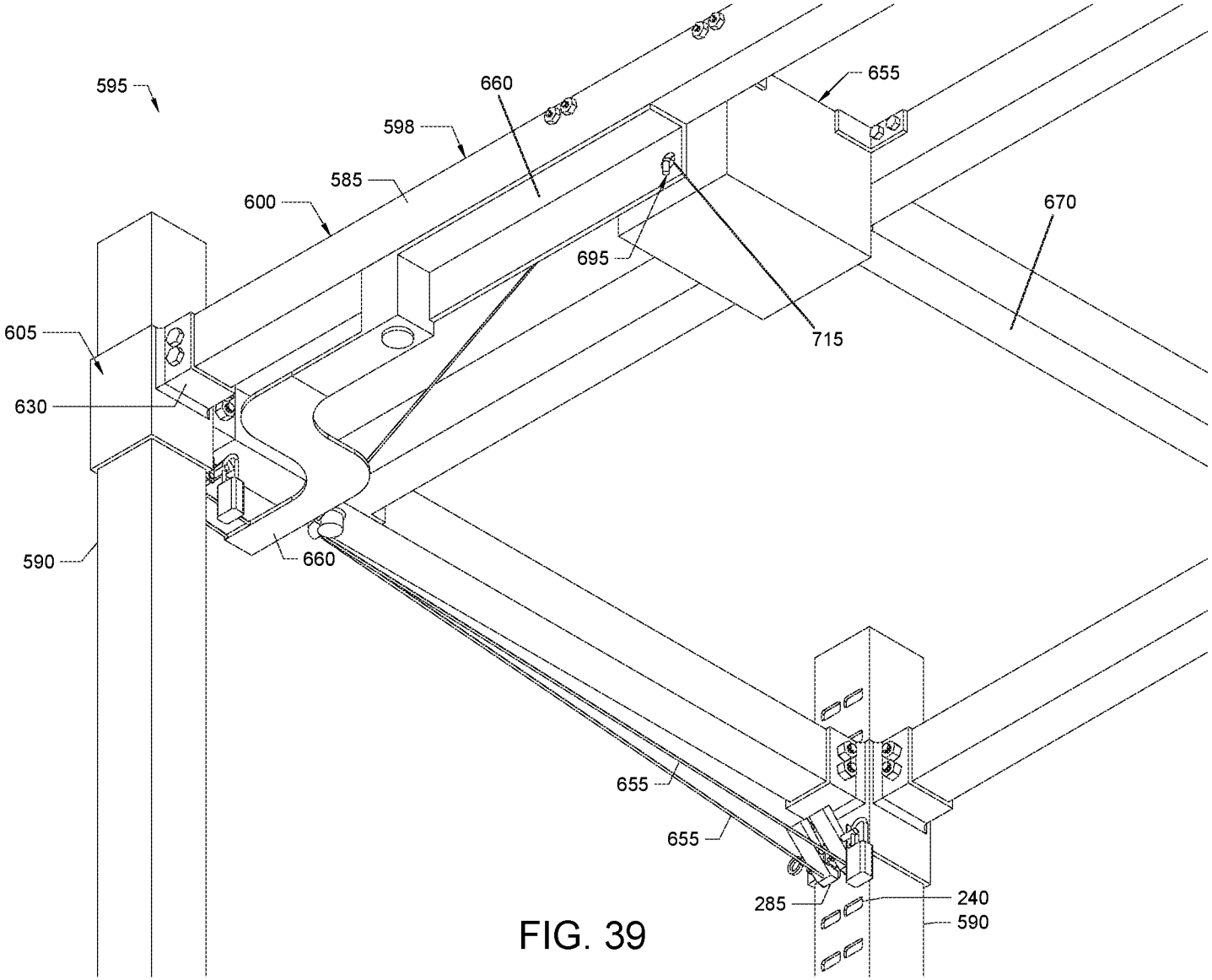
FIG. 39 is a bottom perspective view of an unactuated adjustable height pallet rack.

The spring box lever system 595 may be used to adjust the height of the shelf skirt 600, illustrated in FIGS. 36 and 39. The spring box lever system 595 includes at least one spring box 655 that activates a lever 660 which uses at least one cable 665 to disengage the lock leg section 285 from the telescoping leg apertures 240 on leg 590 which allows the shelf skirt 600 to be raised or lowered. In alternative embodiments, lever 660 may be another cable. In greater detail, when the forklift is used to adjust the height of the pallet rack 598, the forklift fork (not shown) should be aligned with a shelf spring box member 670 and be inserted into the at least one spring boxes 655. The shelf spring box member 670 is preferably part of the shelf skirt 600 and located directly in front of the spring box 655. In some embodiments, the at least one shelf spring box member 670 may include lubricated ball bearings to decrease friction between the shelf spring box member 670 and the forklift forks when the forklift forks are inserted into the at least one spring boxes 655. The spring box 655 is preferably a rectangular housing of any shape and size that is enclosed on five of its six sides, therefore allowing a forklift fork to be inserted into the spring box 655. As seen in FIG. 37, when the forklift forks are inserted into the at least one spring boxes 655, the forklift forks contact a push plate 675 within the at least one spring box 655. When the push plate 675 is pushed by the forklift forks, a spring box handle 680 is also thrust backwards, and therefore also actuates the lever 660 which will be explained in greater detail hereinafter.

Figure 38:
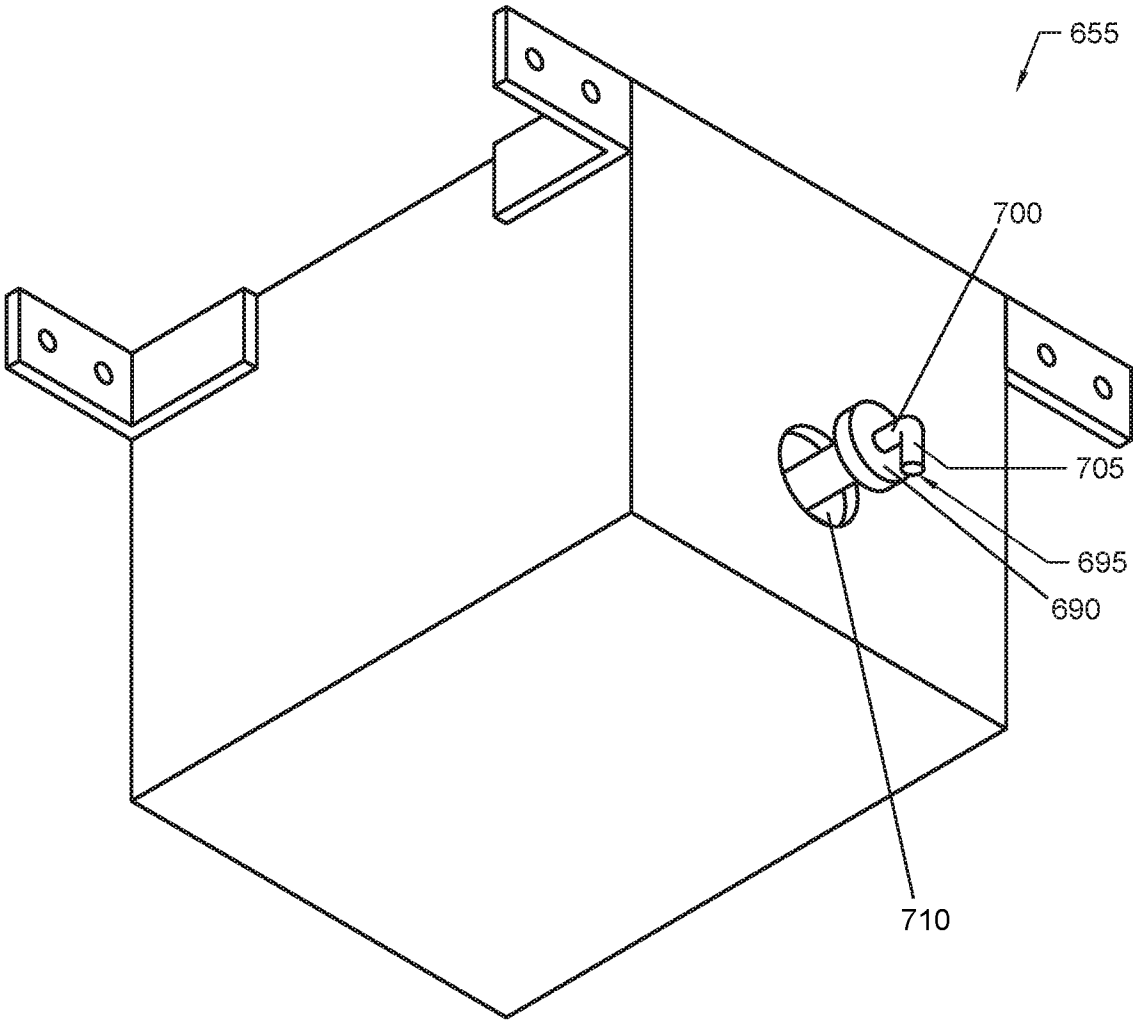
FIG. 38 is a bottom perspective view of the spring housing box of FIGS. 34, 36, and 37.

As illustrated in FIGS. 37-38, the at least one spring box 655 further includes at least one spring box spring 685 thereby allowing the push plate 675 to move back to its default position due to the at least one spring box spring 685 decompressing, which are compressed when the forklift forks come into contact with and pushes the push plate 675. The spring box handle 680 includes a spring box lever contact 690 and a hook 695. The spring box lever contact 690 is preferably a circular substantially planar component adjacent and attached to the hook 695. Hook 695 includes a hook member 700 and an angled hook member 705. The hook member 700 is preferably an elongated member substantially perpendicular to the spring box lever contact 690, and is adjacent and attached to the angled hook member 705 located and positioned at perpendicular angle to the hook member 700. The at least one spring box 655 also includes a spring box lever contact aperture 710 shaped and sized so that the spring box lever contact 690 is flush with the wall of the spring box 655 when the push plate is in its default position.

The spring box 655 includes a hook aperture 715, where the hook 695 is inserted into and through hook aperture 715, so that lever 660 is in between hook 695 and spring box lever contact 690. Thus, when the forklift forks press against the push plate 675, both the push plate 675 and the spring box lever contact 690 are pushed back. The pushing of the spring box contact 690 actuates the lever 660, where the lever 660 pulls at least one cable 665, and the pulling of the at least one cables 665 pulls the lock leg section 285 out of the telescoping leg apertures 240 of the leg 590 thereby allowing the shelf skirt 600 to be raised or lowered, as shown in FIG. 39.

The various constructions described above and illustrated in the drawings are presented by way of example only and are not intended to limit the concepts and principles of the present invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present constructions and systems will, however, become apparent to those skilled in the art after considering the specification and the accompanying drawings. All such changes, modifications, variations and other uses and applications which do not depart from the spirit and scope of the invention are deemed to be covered by the invention.

What is claimed is:

1. A height adjustable apparatus comprising:

at least one horizontal component;

at least two legs each having at least two telescoping leg apertures for adjusting the height of the at least one horizontal component;

at least one slide locking mechanism located and positioned adjacent and attached to the each leg and having a lock base section, a lock lever section, a lock leg section, and a torsional spring for biasing the lock leg section towards the leg; and the lock leg section selectively engaging the telescoping leg aperture thereby preventing the height of the at least one horizontal component from being adjusted and for selectively maintaining the height of the at least one horizontal component.

2. The height adjustable apparatus of claim 1, wherein each leg having at least one inner leg section and at least one outer leg section, the inner leg section selectively nests within the outer leg section for adjusting the length of the leg.

3. The height adjustable apparatus of claim 1, wherein the height adjustable apparatus includes a safety pin;

the lock lever section having a leg height safety aperture wherein the safety pin may be selectively inserted into the leg height safety aperture to selectively prevent the lock leg section from disengaging the telescoping leg aperture.

4. The height adjustable apparatus of claim 1, wherein the height adjustable apparatus further includes at least one cable and at least one hand actuated controller;

the at least one cable attached to the at least one hand actuated controller, the at least one hand actuated controller adjacent and attached to at least one leg;

the at least one cable further attached to and engages the at least one slide locking mechanism so that the height of the at least one horizontal component may be adjusted.

5. The height adjustable apparatus of claim 1, wherein the slide locking mechanism further includes a pull tab handle adjacent and attached to the lock leg section.

* * * * *